US009574292B2

(12) United States Patent
Carrier et al.

(10) Patent No.: US 9,574,292 B2
(45) Date of Patent: Feb. 21, 2017

(54) METHOD OF DYNAMICALLY CHANGING STITCH DENSITY FOR OPTIMAL QUILTER THROUGHPUT

(71) Applicant: L & P Property Management Company, South Gate, CA (US)

(72) Inventors: Joshua A. Carrier, Carl Junction, MO (US); John Tony Garrett, Carthage, MO (US); Jefferson W. Myers, Joplin, MO (US); Terrance L. Myers, Joplin, MO (US); Jason B. Turner, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 28 days.

(21) Appl. No.: 14/665,425

(22) Filed: Mar. 23, 2015

(65) Prior Publication Data

US 2015/0267330 A1 Sep. 24, 2015

Related U.S. Application Data

(60) Provisional application No. 61/969,576, filed on Mar. 24, 2014.

(51) Int. Cl.
*D05B 11/00* (2006.01)
*D05B 19/12* (2006.01)

(52) U.S. Cl.
CPC ..... *D05B 11/00* (2013.01); *D05B 19/12* (2013.01)

(58) Field of Classification Search
CPC ..... D05B 11/00; D05B 21/00; D05B 19/00; D05B 19/04; D05B 19/08; D05B 19/12; D05B 19/16; G05B 19/18; G05B 2219/2626; G05B 2219/45195; D05C 5/00; D05C 5/02; D05C 5/04; D05C 5/06; D05C 5/12; D05C 9/06
See application file for complete search history.

(56) References Cited

U.S. PATENT DOCUMENTS 5,094,180 A 3/1992 Salganik
5,179,520 A * 1/1993 Hayakawa ..... D05B 19/08 112/102.5
5,255,198 A 10/1993 Yokoe et al.
(Continued)

OTHER PUBLICATIONS

International Search Report with Written Opinion dated Jun. 15, 2015 in Application No. PCT/US2015/022140, 10 pages.

*Primary Examiner* — Ismael Izaguirre
(74) *Attorney, Agent, or Firm* — Shook, Hardy & Bacon L.L.P.

(57) ABSTRACT

A method of dynamically changing stitch density of a quilting pattern during sewing is provided. Embodiments of the invention include dynamically changing stitch density along an axis of a sewing pattern based on identifying sewing pattern elements, which may include line segments and arc segments. Each of the line segments and/or arc segments is assigned a dynamically adjusted stitch density based on analysis of each pattern element and/or adjacent element. An adjusted stitch density is assigned to portions of pattern elements that satisfy a threshold measurement for sewing with an adjusted stitch density. In embodiments, a standard stitch density, intermediate stitch density, or an altered stitch density is automatically assigned to each portion of a sewing pattern based on an analysis of threshold length of an element, a threshold angle of a portion of the element with respect to the axis, and/or the stitch density assigned to an adjacent element.

17 Claims, 13 Drawing Sheets

(56) References Cited

U.S. PATENT DOCUMENTS

| | | | | |
|---|---|---|---|---|
| 5,379,707 | A | 1/1995 | Asano | |
| 5,537,945 | A | 7/1996 | Sugihara et al. | |
| 5,559,711 | A | 9/1996 | Futamura et al. | |
| 5,740,057 | A | 4/1998 | Futamura | |
| 5,794,553 | A * | 8/1998 | Futamura | D05B 19/08 112/102.5 |
| 5,839,380 | A | 11/1998 | Muto | |
| 6,390,005 | B1 * | 5/2002 | Chia | D05B 19/08 112/475.19 |
| 6,510,360 | B1 | 1/2003 | Kaymer et al. | |
| 8,271,123 | B2 * | 9/2012 | Yamada | D05C 5/04 112/470.01 |
| 2007/0129840 | A1 * | 6/2007 | Nobuyuki | D05B 19/10 700/138 |
| 2008/0127871 | A1 * | 6/2008 | Tashiro | D05B 19/08 112/470.01 |
| 2014/0094952 | A1 * | 4/2014 | Goldman | F21V 9/00 700/138 |

* cited by examiner

METHOD OF DYNAMICALLY CHANGING STITCH DENSITY FOR OPTIMAL QUILTER THROUGHPUT

CROSS-REFERENCE TO RELATED APPLICATIONS

This application claims priority to U.S. Provisional Patent Application No. 61/969,576, filed Mar. 24, 2014, entitled "Method of Dynamically Changing Stitch Density for Optimal Quilter Throughput,", the entire content of which is hereby incorporated by reference.

STATEMENT REGARDING FEDERALLY SPONSORED RESEARCH OR DEVELOPMENT

Not applicable.

TECHNICAL FIELD

Embodiments of the present invention relate to a method of and system for dynamically changing stitch density to optimize quilter throughput. More particularly, embodiments of the present invention relate to a method of dynamically changing the stitch density of a pattern being sewn by a quilting machine based on automatically analyzing particular pattern elements and assigning corresponding stitch densities.

BACKGROUND OF THE INVENTION

In the manufacture of sewn material, such as quilted bedding material, different patterns may be sewn with varying levels of difficulty. For example, a quilting pattern may include intricate and/or detailed pattern elements that are optimally stitched at a higher stitch density which provides greater accuracy during sewing. The entire quilted pattern may then be sewn under such constraints, limited to the higher stitch density preference and/or requirement by only portions of the pattern. However, the constraints of such intricate areas of sewing may prove problematic from an efficiency and manufacturing perspective, as throughput and cosmetic versatility of the rest of the pattern are sacrificed. Other portions of the quilting pattern having minimal detail are typically also sewn at the same stitch density as the rest of the quilting pattern, despite the fact that these portions may be preferentially stitched and/or require a much lower stitch density than that of the more detailed pattern elements. For example, in a traditional machine-quilting system, the quilted pattern is sewn at a consistent stitch density (i.e., a higher stitch density for patterns including detailed elements) regardless of the particular characteristics of each portion of the pattern. Accordingly, a need exists for a system and method for sewing a particular stitch density within particular elements of a pattern, such as by alternating between a higher stitch density, an intermediate stitch density, and a lower stitch density, based on characteristics of quilting pattern elements.

BRIEF SUMMARY OF THE INVENTION

The present invention generally relates to a method of and system for dynamically changing stitch density of a pattern being sewn through a quilting machine. Embodiments of the invention dynamically change stitch density during sewing, thereby optimizing yardage throughput of a quilting machine while keeping sewing speeds at a constant stitches per minute (SPM) and/or revolutions per minute (RPM) rate. As such, without changing sewing speed, embodiments of the present invention may be used to dynamically maximize the yardage of a sewing and/or quilting machine for sewing an existing pattern, based on analyzing a sewing/quilting pattern and automatically applying variable stitch densities within particular elements of the pattern. For example, a method for dynamically changing stich density during sewing may include sewing at a constant rate (e.g., SPM) while automatically concentrating more stitches at areas of determined higher stitch density, and automatically concentrating fewer stitches at areas of determined lower stitch density.

In further embodiments, system and methods for dynamically changing stitch density during sewing provides a real-time analysis of various elements of a sewing pattern, such as elements of a quilting pattern. Accordingly, the analysis of the present invention may provide pattern-specific stitch densities that automatically adjust for pattern elements requiring a lower stitch density than other areas of sewing. Similarly, embodiments of the invention that dynamically alter stitch density during sewing provide pattern-specific stitch densities for elements that may be stitched with a greater stitch definition and a corresponding higher stitch density, relative to surrounding lower stitch density elements. Optimal stitch density or a preferred stitch density may be defined as a number of stitches per inch that may be used when sewing so as to preserve and/or enhance one or more desired details of a sewing pattern, for example.

Embodiments of the present invention include a method of and system for assigning a variable stitch density within multiple elements of a particular pattern. In one illustrative embodiment of the invention, a method for automatically assigning a first stitch density to a first pattern element, and assigning a second stitch density to a second pattern element, is provided. The first stitch density may include a lower number of stitches per inch than the second stitch density. In another embodiment, a first and second stitch density may be determined with respect to a standard stitch density. As such, embodiments of the invention may be used to automatically assign (1) a first stitch density that is lower than the standard stitch density to a first set of pattern elements, (2) a second stitch density higher than the standard stitch density to a second set of pattern elements, and (3) a standard stitch density to a third set of pattern elements. In such an embodiment, the first, second, and third sets of pattern elements are not the same. Accordingly, the present invention may be used to automatically identify particular elements of a sewing pattern that are determined to require less stitch definition and are therefore eligible for sewing with a lower stitch density than surrounding portions of the pattern. Such a lower stitch density may be referred to as sewing a "wild stitch" density. In further embodiments, particular elements of a sewing pattern (e.g., a first, second, and/or third set of pattern elements) requiring a higher stitch definition and corresponding higher stitch density than surrounding portions of the pattern may be automatically identified. Further, an optimal stitch definition and/or corresponding optimal stitch density for portions of the pattern may be determined as well. Optimal stitch definition, optimal stitch density, and/or a preferred stitch density for one or more portions of the pattern and/or the whole pattern, may be defined by a least amount of yardage required, a greatest amount of yardage needed, a slowest stitch speed (e.g., SPM) for a determined stitch density, a fastest stitch speed (e.g., SPM) for a determined stitch density, a lower threshold stitch density for a particular material to be stitched, and/or an upper threshold stitch density for a particular material to be stitched, in various embodiments.

In one embodiment of the invention, a method for dynamically changing stitch density along an axis of a sewing pattern is provided. The method includes determining a plurality of elements of a sewing pattern, the plurality of elements comprising at least one of one or more line segments and one or more arc segments; analyzing each of the one or more line segments and one or more arc segments; and dynamically adjusting a stitch density corresponding to at least one of the plurality of elements, wherein dynamically adjusting the stitch density comprises assigning an adjusted stitch density to at least one of the plurality of elements based on the analysis of each of the one or more line segments and one or more arc segments.

In another illustrative aspect, a method for automatically adjusting stitch density between elements of a sewing pattern for sewing along an axis includes: receiving a pattern having a plurality of pattern elements, wherein each of the plurality of pattern elements comprises one or more portions; analyzing each of the one or more portions of the plurality of pattern elements to determine whether each of the plurality of pattern elements does or does not satisfy a threshold for assigning an altered stitch density to at least one portion of the plurality of pattern elements; and based on the analysis of each of the one or more portions, assigning at least one of a standard stitch density, an altered stitch density, and an intermediate stitch density to each of the one or more portions of the plurality of pattern elements.

According to a third illustrative aspect, embodiments of the invention are directed to a method for automatically assigning variable stitch densities to pattern elements of a sewing pattern. The method includes: receiving a sewing pattern having a plurality of pattern elements, wherein the plurality of pattern elements comprises at least one of one or more line segments and one or more arc segments; analyzing each of the plurality of pattern elements to determine whether at least a portion of each of the plurality of pattern elements satisfies a threshold length and a threshold angle with respect to an axis; and automatically assigning a corresponding stitch density to each of the plurality of pattern elements based on the analysis.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Figure 2:
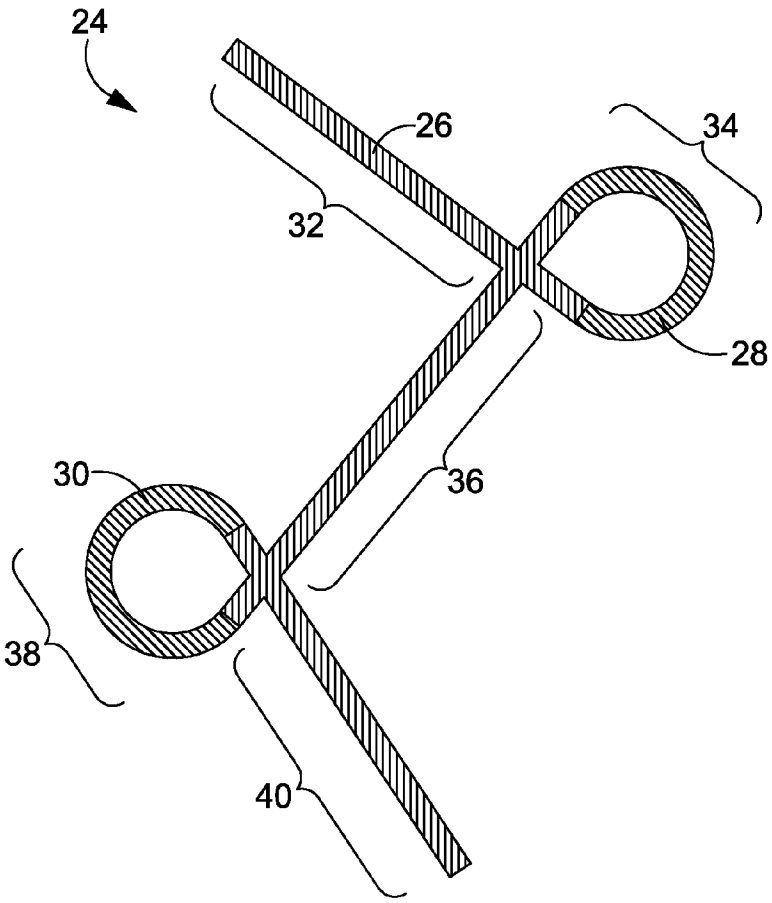
FIG. 2 is an exemplary pattern sewn with a variable stitch density, in accordance with an embodiment of the invention.

The present invention generally relates to a method of and system for dynamically changing stitch density for optimal quilter throughput. Embodiments of the invention include determining which portions of a quilting pattern, if any, satisfy a threshold requirement for sewing an alternate stitch density that varies from a standard stitch density originally applied to a sewing pattern. As used herein, "requirement" is not to be construed as a strict or absolute limitation, but rather, merely refers to or defines one or more preferred or optimized measurements (e.g., threshold angle) that are employed by the invention herein to achieve its purposes. A "requirement," with regard to any number of applicable thresholds described hereinafter, may be a range of relevant measurements (e.g., inches, degrees) determined within a pattern, may be predetermined, may be defined by a user, may be determined by machine settings, or manufacturing constraints, in various embodiments. In some embodiments, a method of dynamically changing stitch density of a pattern being sewn through a quilting machine includes determining whether portions of particular elements of a pattern satisfy threshold requirements for dynamically altering stitch density (i.e., for applying a "wild stitch").

Based on the analysis of some embodiments of the invention, the stitch density of particular portions of a sewing pattern are dynamically changed, thereby optimizing yardage throughput of a quilting machine while keeping sewing speeds at a constant SPM and/or RPM rate. As such, without changing sewing speed, embodiments of the present invention may be used to dynamically maximize the yardage of a sewing and/or quilting machine for sewing/quilting an existing pattern. Based on analyzing a sewing/quilting pattern and automatically applying variable stitch densities within particular elements of the pattern, an amount of sewn thread (i.e., thread yardage consumed) may be reduced relative to an amount of sewn thread needed to sew the same pattern with a constant, higher stitch density. Additionally, in embodiments of the invention, sewing reliability may be maintained while yardage throughput is optimized. In one embodiment, sewing reliability may refer to the ability to not skip and/or miss stitches throughout sewing or quilting a pattern.

In further embodiments, dynamically changing stitch density during sewing provides a real-time analysis of various elements of a sewing pattern, such as elements of a quilting pattern. Accordingly, the analysis of the present invention may provide pattern-specific stitch densities that automatically adjust for pattern elements requiring a lower stitch density than other areas of sewing. Similarly, embodiments of the invention that dynamically alter stitch density during sewing provide pattern-specific stitch densities for elements that require greater stitch definition and a corresponding higher stitch density, relative to surrounding lower stitch density elements. In further embodiments of the invention, a standard stitch density may be applied to an entire quilting pattern, and upon applying the analysis of the present invention, one or more portions of the quilting pattern may be identified as qualifying for sewing at a lower stitch density than the standard stitch density. Accordingly, such lower stitch density adjustments may result in conserving thread yardage (e.g., less thread yardage may be required or used when executing a sewing pattern or portion thereof). Further embodiments of the invention include an analysis of pattern elements traditionally sewn with a standard stitch density to determine whether the threshold requirements are met for changing the stitch density for the identified portion of the pattern element.

Embodiments of the invention include a method of and system for assigning a variable stitch density within multiple elements of a particular pattern. In one illustrative embodiment of the invention, a method for automatically assigning a first stitch density to a first pattern element and assigning a second stitch density to a second pattern element is provided. The first stitch density may include a lower number of stitches per inch than the second stitch density. Accordingly, the present invention may be used to automatically identify particular elements of a sewing pattern that are determined to require less stitch definition and are therefore eligible for sewing with a lower stitch density than surrounding portions of the pattern. As such, particular portions of a sewing pattern may be identified as qualifying for sewing using a "wild stitch" (i.e., lower stitch density than the remainder of the quilting pattern).

Figure 1:
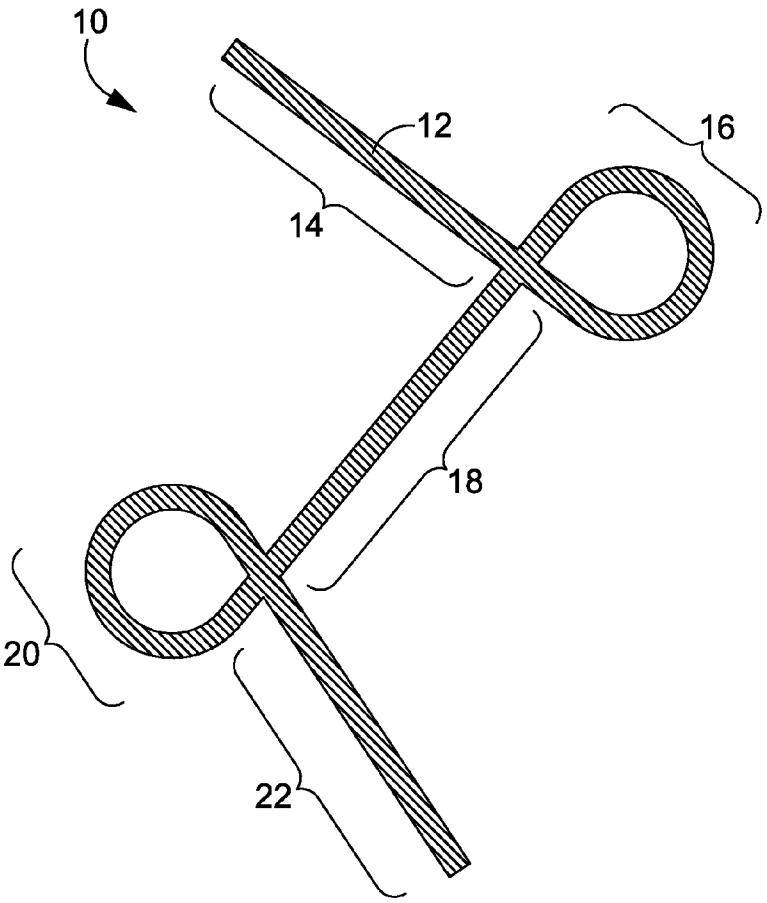
FIG. 1 is an exemplary pattern sewn with a consistent stitch density, in accordance with an embodiment of the invention.

Turning now to the exemplary embodiments in the Figures, an embodiment of an exemplary pattern 10 is seen in FIG. 1, sewn with a consistent stitch density 12. As shown in FIG. 1, an exemplary pattern may include multiple pattern elements that are identified according to the method of the present invention. An element, as used hereinafter, generally refers to a visually identifiable design aspect that may be distinguishable from others aspects. For example, a design aspect such as a straight line may be visually distinguished from a curved line, and a right angle (e.g., a sharp corner shape formed by a sewn line) may be visually distinguished from an obtuse angle (e.g., a corner shape formed by a sewn line of two line segments having an angle of greater than 90 degrees, the angle measured with respect to a vertex formed by the two line segments). As such, in some embodiments, a first element 14, a second element 16, a third element 18, a fourth element 20, and a fifth element 22 may be identified as distinct portions of the quilting pattern 10 requiring an analysis of which stitch density to apply to each pattern element during sewing. For example, such an analysis may be used to determine whether a "wild stitch" (i.e., an altered stitch density) may be applied. In other words, each of the elements of the quilting pattern may be analyzed to determine whether to switch to an altered stitch density (e.g., adjusted to higher or lower stitch density that a standard stitch density) when sewing distinct pattern elements within the pattern 10.

With reference now to FIG. 2, the exemplary quilting pattern 24 depicts a method of dynamically changing stitch density during sewing. In some embodiments, dynamically changing stitch density includes automatically changing between more than one stitch density (e.g., between low, intermediate, and high stitch densities; or between standard and altered stitch densities) without manually identifying particular pattern elements for which particular stitch densities should be applied or used. In the example of FIG. 2, the pattern 24 is sewn with a variable stitch density based on changing elements of the pattern 24. As such, a first stitch density 26 is used for sewing a first element 32, a third element 36, and a fifth element 40, while a second stitch density 28 and 30 is used to sew a second element 34 and a fourth element 38. In embodiments, second stitch densities 28 and 30 are the same stitch density, applied to similar elements of the pattern 24. For example, for straight line segments of the quilting pattern 24, such as the first portion 32, third portion 36, and fifth portion 40, embodiments of the invention may determine to sew the pattern at a first stitch density 26. In further embodiments, for curved and/or arc segments of particular portions of the quilting pattern 24, such as the second portion 34 and the fourth portion 38, embodiments of the invention may determine to sew the pattern at a second stitch density 28 and/or 30. As such, for straight line segments of the pattern 24, a lower, altered stitch density (i.e., "wild stitch") may be applied to those portions of the pattern 24 that require less stitch definition (e.g., a straight line). Similarly, a higher stitch density, such as a standard stitch density higher than the altered stitch density, may be applied to the remaining portions of the pattern 24, including exemplary second portion 34 and fourth portion 38.

Figure 3:
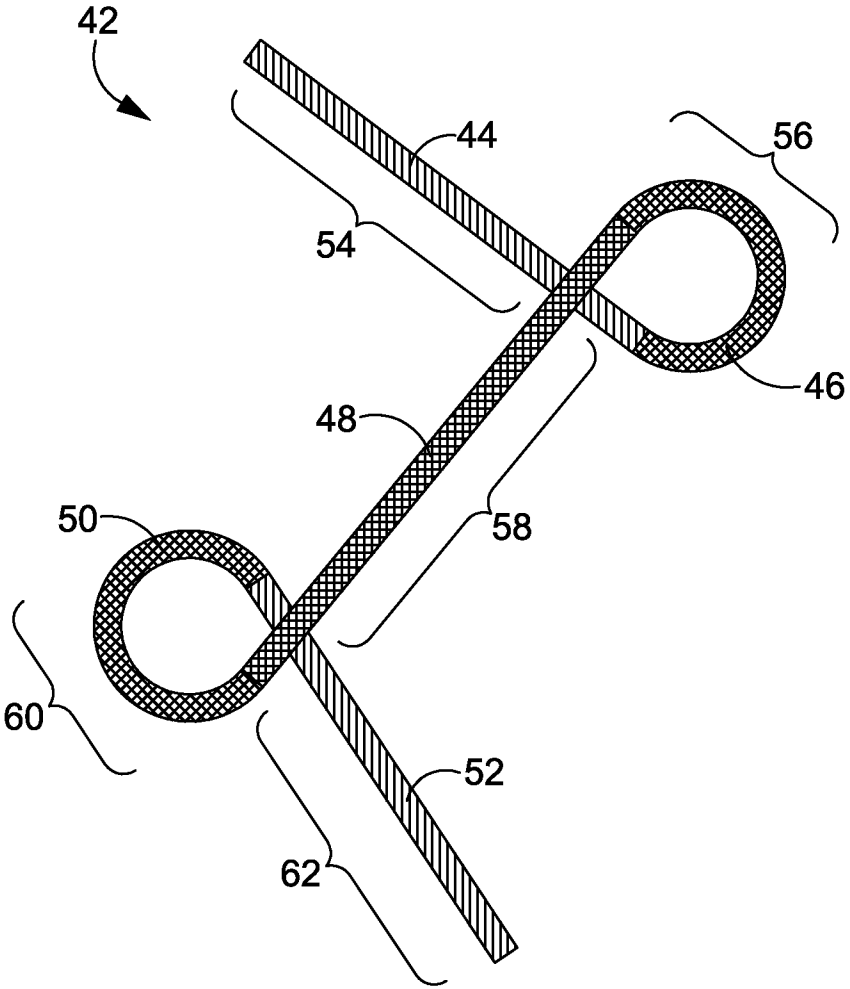
FIG. 3 is an exemplary pattern sewn with a variable stitch density, in accordance with an embodiment of the invention.

Turning now to FIG. 3, the exemplary pattern 42 includes a variable stitch density for multiple different elements of a sewing pattern, such as a quilting pattern. Embodiments of the pattern 42 include a first element 54 sewn at a first density 44, a second element 56 sewn at a second density 46, a third element 58 sewn at a third density 48, a fourth element 60 sewn at a fourth density 50, and a fifth element 62 sewn at a fifth density 52. In embodiments, each of the first, second, third, fourth, and fifth pattern elements 54, 56, 58, 60, and 62 may be determined to be sewn with variable stitch densities 44, 46, 48, 50, and 52. In some embodiments, a threshold analysis of the elements (e.g., 54, 56, 58, 60, and 62) of the pattern 42 is conducted in order to identify and/or determine whether one or more of the elements (e.g., 54, 56, 58, 60, and 62) of the pattern 42 are to be sewn using a standard stitch density and whether one or more of the elements (e.g., 54, 56, 58, 60, and 62) are to be sewn using an altered stitch density. In an embodiment, threshold analysis determinations of stitch density for the elements (e.g., 54, 56, 58, 60, and 62) of the pattern 42 are made such that the stitch densities determined for each of the elements (e.g., 54, 56, 58, 60, and 62) do not compromise sewing machine performance, quality of a final product, or rates of throughput.

In further embodiments, the variable stitch densities 44, 46, 48, 50, and 52 may be different for each other, and may be categorized as being low, intermediate, or high stitch densities. For example stitch density 44 might include a stitch density greater than stitch density 46. Further, stitch density 48 might be an intermediate stitch density, such that it is a lower stitch density than stitch density 46 but is a higher stitch density than stitch density 44. In a further embodiment, the variable stitch densities 44, 46, 48, 50, and 52 may incrementally and/or gradually increase or decrease stitch density according to a method of the invention. Such a gradual increase or decrease when transitioning between differing stitch densities may allow each variable stitch density to approach the stitch density assigned to an adjacent and/or consecutive element (i.e., gradually arrive at a neighboring stitch density). For example, the variable stitch density 44 assigned to element 54 may gradually increase its stitch density as the sewing distance between element 54 and 56 decreases (e.g., as a sewing head continues sewing from element 54 to element 56). As such, in one embodiment of the invention, the stitch density of a portion of element 54 may gradually "ramp up" to the stitch density assigned to element 56. In this example, the variable stitch density 44 may incrementally and/or gradually increase in stitch density for a portion of element 54 that is closest to the beginning of element 56. In alternative embodiments, a stitch density assigned to an element of a pattern may "ramp down," to include an intermediate stitch density for the portion of a first element adjacent a second element having a stitch density lower than the first element.

In some embodiments, a variety of stitch densities may be assigned to each element (and subsequently sewn for each corresponding element) according to a threshold analysis of the various elements within the pattern. For example, the length of a straight line, the curvature of an arc segment, the angle of an element in relation to an axis, and/or the relation of one element to another may be analyzed. In some embodiments, additional factors might further include evaluation of one or more technical aspects of and production, such as potential needle deflection, the type of machine employed (e.g., needle and looper vs. needle and bobbin sewing systems), and the characteristics of the material being sewn, quilted, embroidered, and/or serged. In embodiments of the invention, one or more algorithms for assigning and/or adjusting variations of stitch density may be employed to optimize accuracy and efficiency, and maximize the yardage while ensuring that sewing reliability is not compromised (e.g., prevention of skipped stitches, bunching or tangling thread, thread breakage). As such, in some embodiments, a particular element may be identified as requiring a particular first sewing density based on a threshold analysis and/or further analysis. For example, a threshold analysis determination may indicate that the first sewing density of the particular element may satisfy one or more thresholds that would enable the particular element to be sewn at a second sewing density, thereby optimizing one or more of accuracy, efficiency, sewn yardage, sewing reliability, and the like.

Figure 4:
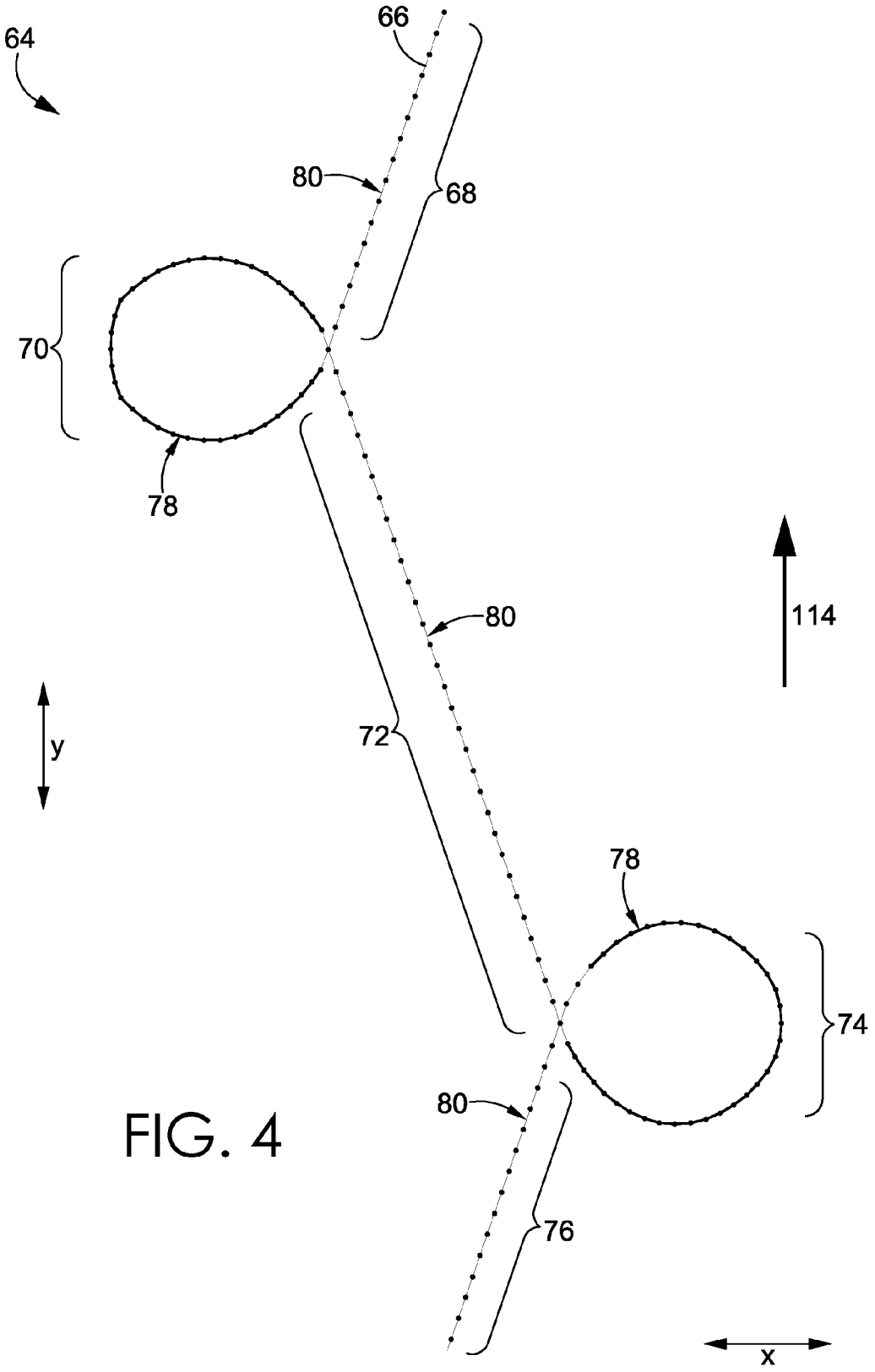
FIG. 4 is an exemplary pattern sewn with a variable stitch density, in accordance with an embodiment of the invention.

Referring next to FIG. 4, a pattern 64 is sewn along an axis 114 with a variable stitch density. In embodiments, sewing a pattern 64 with a variable stitch density refers to sewing a pattern 64 with at least one portion of at least one element of the pattern 64 sewn at a first stitch density, and at least one portion of at least one element of the pattern 64 sewn at a second stitch density. For example, one element of a pattern 64 may include a straight line segment, with a first portion of the line segment sewn at a first stitch density and a second portion of the line segment sewn at a second stitch density. In some embodiments of the invention, a line segment might include one or more portions. Similarly, one element of a pattern 64 may include an arc segment (e.g., a curved element of a pattern), with a first portion of the arc segment sewn at a first stitch density and a second portion of the arc segment sewn at a second stitch density. As such, embodiments of the invention may be used to determine which portions of each pattern element to sew at a first stitch density (e.g., a standard stitch density) and which portions of each pattern element to sew at a second stitch density (e.g., an altered stitch density). In further embodiments, any number of varying stitch densities may be applied to any number of different portions of pattern elements, such as a third stitch density for sewing a portion of at least one element of the pattern 64. In embodiments, multiple elements that are identified according to the present invention may be assigned one of multiple stitch densities for sewing with a variable stitch density, at a constant rate of sewing.

In the embodiment of FIG. 4, pattern 64 depicts a sewn pattern 66 that includes a variety of elements, such as a first line segment 68, a first arc segment 70, a second line segment 72, a second arc segment 74, and a third line segment 76. In embodiments of the invention, based on a determination regarding whether each portion of each element satisfies one or more threshold requirements, each segment of the sewn pattern 66 is assigned a stitch density for sewing. As shown in the embodiment of FIG. 4, the stitch density is dynamically changed according to the method of the invention, during sewing along the axis 114. In some embodiments, the axis 114 may be an x-axis, wherein the x-axis corresponds to a carriage axis of a sewing apparatus executing a sewing pattern (and/or preparing to execute at least a portion of the sewing pattern). Alternatively, in a further embodiment, the axis 114 may be a y-axis, wherein the y-axis corresponds to a feed axis of a sewing apparatus executing the sewing pattern (and/or preparing to execute at least a portion of the sewing pattern). In some embodiments, the orientation of the axis 114 corresponds to a determination regarding one or more technical aspects of a sewing process (e.g., type of machine or device associated with sewing the sewing pattern). In the embodiment of FIG. 4, while a material for sewing advances along the axis 114, the sewn pattern 66 may be sewn onto the material at a constant rate, having variable stitch densities throughout the sewn pattern 66.

In one embodiment of the present invention, first line segment 68 is determined to satisfy a threshold requirement for assigning an altered stitch density 80 to the first line segment 68. In embodiments, first line segment 68 satisfies a threshold length and a threshold angle with respect to the axis 114, and is therefore assigned altered stitch density 80 (i.e., "wild stitch" density). In further embodiments, based on analysis of one or more portions of the first arc segment 70, first arc segment 70 is determined not to satisfy the threshold requirement for assigning altered stitch density 80, and is therefore sewn at standard stitch density 78. In embodiments, second line segment 72 and third line segment 76 are also determined to satisfy the threshold requirement for assigning an altered stitch density 80, while second arc segment 74 is similarly determined not to satisfy the threshold requirement for assigning altered stitch density 80, and is therefore assigned the standard stitch density 78. In one example, because of the high level of detail (i.e., high stitch definition) required for sewing the first arc segment 70 and the second arc segment 74, both segments are assigned a standard stitch density 78. In further embodiments, because of the low level of detail (i.e., less stitch definition) required for sewing the first line segment 68, the second line segment 72, and the third line segment 76, all three line segments are assigned an altered stitch density 80, which enables such portions to be sewn with greater throughput at the same rate of sewing as the remainder of the pattern (i.e., by only adjusting a number of stitches sewn in a specified distance, such as stitches per inch).

It may be determined that first arc segment 70 and second arc segment 74 do not meet and/or satisfy the threshold requirement for assigning an altered stitch density 80. The first and second arc segments 70 and 74 exhibit a tight, circular-shaped or elliptical-shaped curvature in FIG. 4. In order for sufficient detail of the curvature of the first and second arc segments 70 and 74 to be preserved during stitching of the sewing pattern 64, for example, a greater concentration of stitches or a higher stitch density is preferred and/or required. The higher stitch density captures more detail of the arc segments 70 and 74 and creates a smooth, full curvature. If a standard stitch density is used, the curvature of the first and second arc segments 70 and 74 may be less smooth which may be undesirable in the finished sewing pattern. Generally, a higher the number of stitches per inch (e.g., SPI) sewn corresponds to a higher level of fine detail that may be captured when sewing a pattern. Thus, an altered stitch density (e.g., "wild stitch") having a SPI that is less than a standard stitch density may be determined to be used for elements that require less or the least amount of detail, for example, an element that is characteristically straight. Using an altered stitch density having a SPI that is less than a standard stitch density may also results in faster sewing speed because fewer SPI are used to sew one or more elements that are determined to have less detail.

Figure 5:
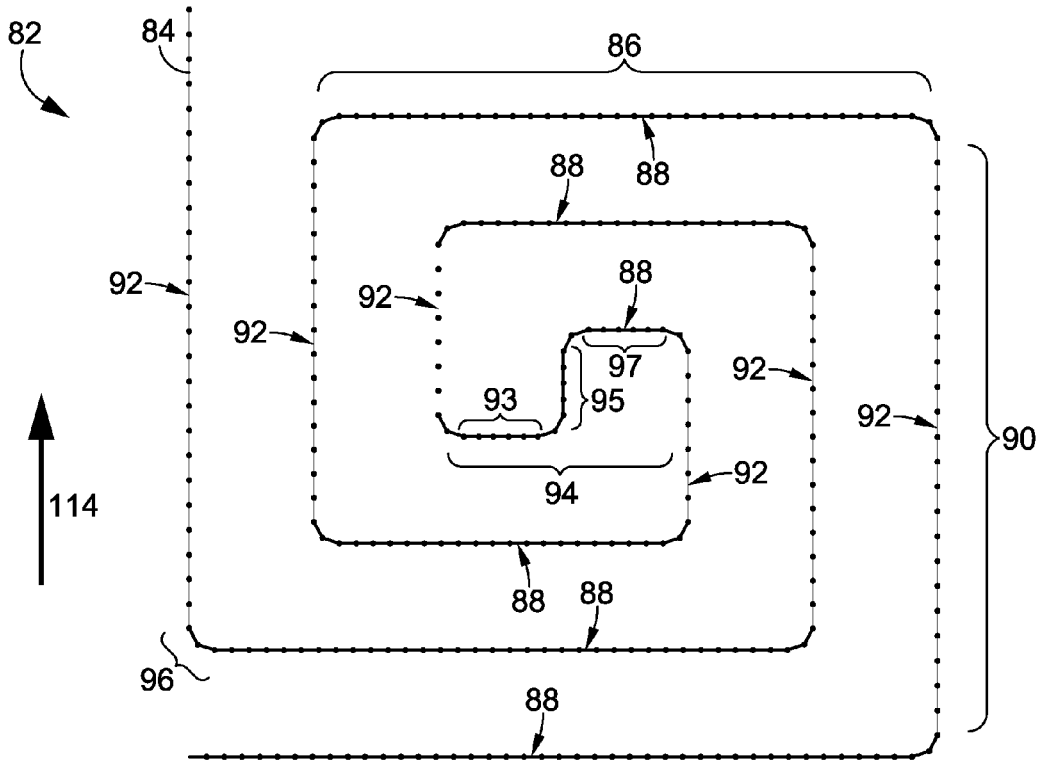
FIG. 5 is an exemplary pattern sewn with a variable stitch density, in accordance with an embodiment of the invention.

With reference now to FIG. 5, an exemplary pattern 82 is sewn along the axis 114 with a variable stitch density, in accordance with an embodiment of the invention. In the embodiment of FIG. 5, the sewing pattern 84 includes multiple different elements for sewing at variable densities. As such, the sewing pattern 84 includes a first line segment 86 sewn at a standard stitch density 88, and a second line segment 90 sewn at an altered stitch density 92. Each portion of the sewn pattern 84 qualifying for an altered stitch density 92 is shown at a lower stitch density, while each portion qualifying for a standard stitch density 88 is shown at a higher stitch density.

As shown in FIG. 5, embodiments of the invention include a determination for whether a portion of a particular element of a pattern 82 does or does not satisfy a threshold for sewing using an adjusted stitch density. In one embodiment, the threshold for sewing using an adjusted stitch density includes a determination of whether a portion of the pattern element satisfies a threshold sewing distance. The threshold sewing distance may be between one half and three inches, according to one aspect. In another embodiment, the threshold sewing distance is at least one inch in length. As such, a portion of a line segment may not qualify to be sewn with an adjusted stitch density, according to an embodiment of the invention, when the portion of the line segment analyzed is determined to be less than a threshold sewing distance of one inch. It should be noted that the sewing distances included here are merely examples and should not be considered limiting, as every sewing pattern may require a different, defined threshold sewing distance based on the elements of each sewing pattern. And, it will be appreciated by those in the art that, depending on application and pattern, a threshold sewing distance on a scale of millimeters up to feet is considered to be within the embodiments considered herein. For example, a threshold sewing distance as defined or determined for the sewing of a parachute may be different in scale than a threshold sewing distance as defined or determined for the sewing of a pillow case.

In one embodiment, because of the length of the sewing pattern within portion 94 of FIG. 5, the entire sewing pattern 82 within the portion 94 is assigned a standard stitch density 88, while none of the individual line segments (e.g., 93, 95 and 97) within the portion 94 satisfy a threshold length for sewing with an altered stitch density 92. Similarly, a portion of an arc segment may not qualify to be sewn with an adjusted stitch density, according to embodiments of the invention, when the portion of the arc segment is less than one inch in length (e.g., a distance from a first point on an arc segment to a second point on the arc segment, wherein the distance is measured along the curvature of the arc segment). As such, each corner segment 96 of the sewing pattern 84 may be sewn at a standard stitch density 88, as shown in FIG. 5, when each corner segment 96 of the sewing pattern 84 is less than the one inch threshold length. For example, a "sharp turn" in a sewing pattern 84 may not satisfy a threshold length, and may retain an assigned standard stitch density such that the integrity of stitch detail on such pattern portion of a "sharp turn" is maintained.

In embodiments, upon satisfying a threshold for a minimum sewing distance, each portion of each element of a sewing pattern is analyzed to determine whether the pattern and/or portions of the pattern satisfy a threshold angle with respect to the axis 114. In one embodiment, having satisfied the threshold length, the threshold angle of a portion of the sewing pattern may be at or below a particular or defined threshold angle, such as 40 degrees or less from the axis 114 to qualify for an altered stitch density. A threshold angle may be generally defined at least in part by the orientation of the portion of the element with respect to the axis 114, regardless of which direction the axis is facing (e.g., x- or y-axis), and regardless of whether the threshold angle is measured with respect to a horizontal or vertical axis with respect to the pattern in relation to the sewing axis. In other words, a portion of a sewing pattern having an angle within 40 degrees on each side of the axis 114 may satisfy a threshold for being sewn with an altered stitch density. It should be noted herein, that with regard to the horizontal and vertical axis mentioned, both are descriptive with respect to the pattern itself and are not meant to a vertical movement of a sewing machine needle, for instance.

Figure 6A:
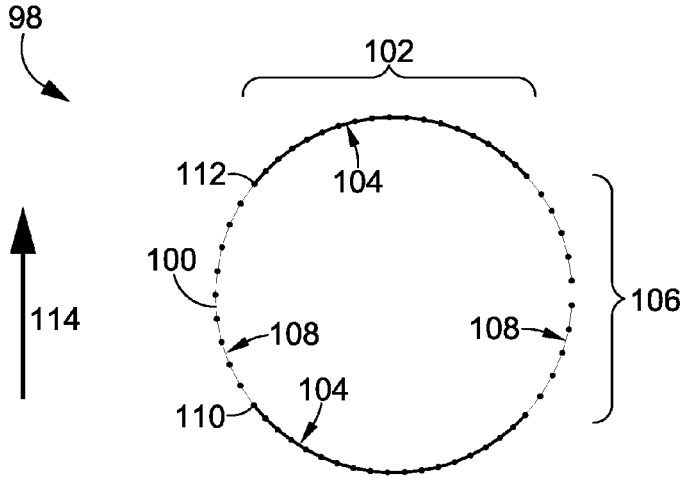
FIG. 6A is an exemplary pattern sewn with a variable stitch density, in accordance with an embodiment of the invention.

Embodiments of the invention may further include a determination for whether a portion of a particular element of a pattern does or does not satisfy a threshold for sewing using an adjusted stitch density. For example, in addition to a determination of satisfying a threshold length, in some embodiments, individual increments of an arc segment may each individually satisfy a threshold angle with respect to an axis in order to be assigned an altered stitch density. In the exemplary pattern 98 of FIG. 6A, the method of sewing a variable stitch density includes determining and sewing multiple, identifiable pattern elements. FIG. 6A includes an arc segment sewing pattern 100 having multiple portions, such as a first portion 102 sewn (e.g., determined to be sewed using a preferred stitch density and/or an assigned a stitch density) at a standard stitch density 104, and a second portion 106 sewn (e.g., determined to have a preferred stitch density and/or assigned a stitch density) at an altered stitch density 108. In embodiments, the portion of the sewing pattern 100 within first portion 102 may not satisfy a threshold angle with respect to the axis 114. Therefore, in that instance, the first portion 102 may not qualify for being assigned an altered stitch density 108, even when the first portion 102 of an arc segment may satisfy a threshold length for sewing with an altered stitch density 108. In embodiments, throughout portions of a sewing pattern 100, a stitch density may change from a first stitch density to a second stitch density (and back to a first stitch density). For example, at point 110, when sewing clockwise relative to the axis 114, the sewing pattern 100 changes from a standard stitch density 104 to an altered stitch density 108 (e.g., "wild stitch" density). Upon continuing to sew the pattern 98, the stitch density may again change at point 112 from an altered stitch density 108 to a standard stitch density 104. In embodiments, the variable density within pattern 98 may depend upon when the sewing pattern 100 changes from not satisfying a threshold angle with respect to the axis 114 to satisfying the threshold angle with respect to the axis 114 (e.g., at point 110). Further, the same sewing pattern 100 changes from satisfying the threshold angle with respect to the axis 114 to not satisfying the threshold angle with respect to the axis 114 (e.g., at point 110), in embodiments. As such, a single arc segment may include multiple portions that are not the same, with each of the multiple portions corresponding to one or more different stitch densities.

Figure 6B:
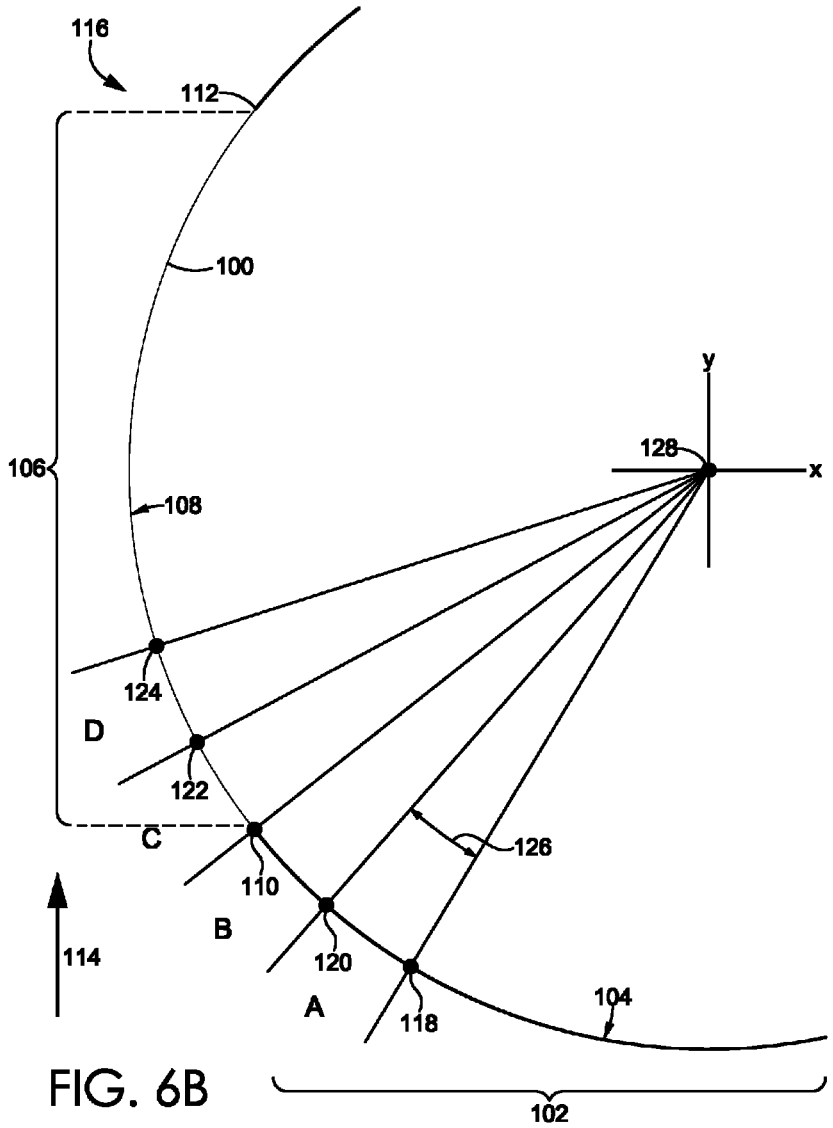
FIG. 6B is an enlarged portion of the exemplary pattern of FIG. 6A, sewn with a variable stitch density, in accordance with an embodiment of the invention.

Turning next to FIG. 6B, an enlarged portion 116 of the exemplary pattern 98 of FIG. 6A is sewn with a variable stitch density, including the first portion 102 sewn at a standard stitch density 104, and the second portion 106 sewn at an altered stitch density 108, in accordance with an embodiment of the invention. In embodiments, a plurality of increments is created along the arc segment of enlarged portion 116, including increments A, B, C, and D. Accordingly, an interpolated arc segment may be any arc segment having multiple increments for comparison with respect to the axis 114. The interpolated arc segment of FIG. 6B defines equal or approximately equal increments for determination of whether at least a portion of the arc segment satisfies a threshold angle with respect to the axis 114, where a portion may include one or more increments. In embodiments, the arc segment of sewing pattern 100 may be interpolated to include multiple increments A, B, C, and D, where each of the increments A, B, C, and D may be approximately evenly spaced at an angle 126 relative to the arc axis 128. As such, when sewing in a clockwise fashion, increment A may have an increment start point at point 118, and an increment stop point at point 120. Similarly, increment B may have an increment start point at point 120, and an increment stop point at point 110; increment C may have an increment start point at point 110, and an increment stop point at point 122; and increment D may have an increment start point at point 122, and an increment stop point at point 124. In the example of FIG. 6B, the arc segment of sewing pattern 100 may be evaluated along each increment of the arc segment, as defined by increments A, B, C, and D. In another example, increments A, B, C, and/or D may be combined, in whole or in part, to provide a portion of the arc segment. During analysis of the sewing pattern 100, a portion of the arc segment including multiple increments may be compared against the axis 114. In some embodiments of the invention, a portion may refer to an increment of a sewing pattern that is adjacent and/or consecutive to another increment. It may be generally understood that adjacent and/or consecutive increments may form at least one continuously sewn portion of the pattern.

Figure 6C:
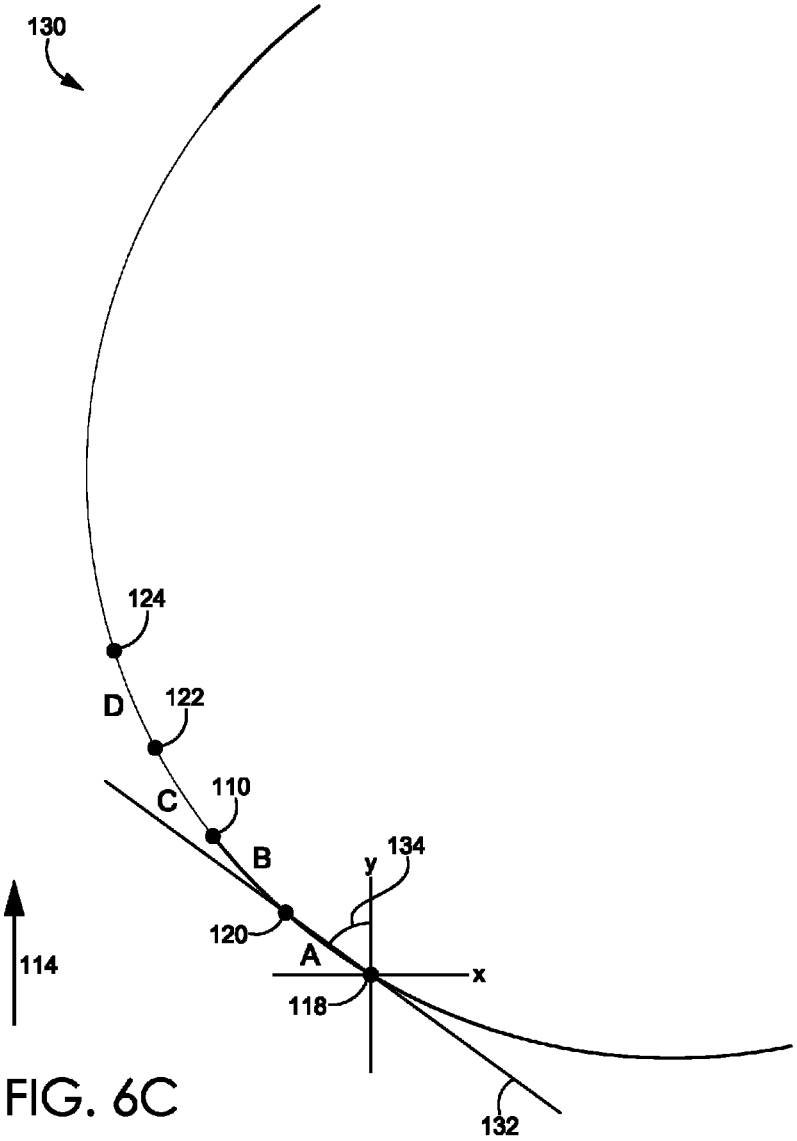
FIG. 6C is an enlarged portion of the exemplary pattern of FIG. 6A, sewn with a variable stitch density, in accordance with an embodiment of the invention.

Accordingly, referring next to FIG. 6C, an enlarged portion 130 of the exemplary pattern 98 of FIG. 6A depicts an embodiment of determining which stitch density to use when sewing various portions comprising one or more elements of the pattern 98. In particular, the embodiment of FIG. 6C depicts utilizing the interpolated increments of FIG. 6B to determine whether a portion of the arc segment may be sewn using an altered stitch density. In further embodiments, having determined that the portion between points 118 and 110 satisfies a threshold length and/or threshold sewing distance, an x-axis and y-axis positioned at point 118 is used to determine an angle of the increment A with respect to the axis 114. In other words, with a line 132 drawn between point 118 and point 120, an angle 134 of the increment A is determined relative to the axis 114 (parallel to the y-axis at point 118). In one embodiment, a determination is made whether the first increment A satisfies a threshold angle with respect to the axis 114. In the embodiment of FIG. 6C, increment A is positioned at an angle greater than the threshold amount from the axis 114, and is therefore assigned a standard stitch density.

Figure 6D:
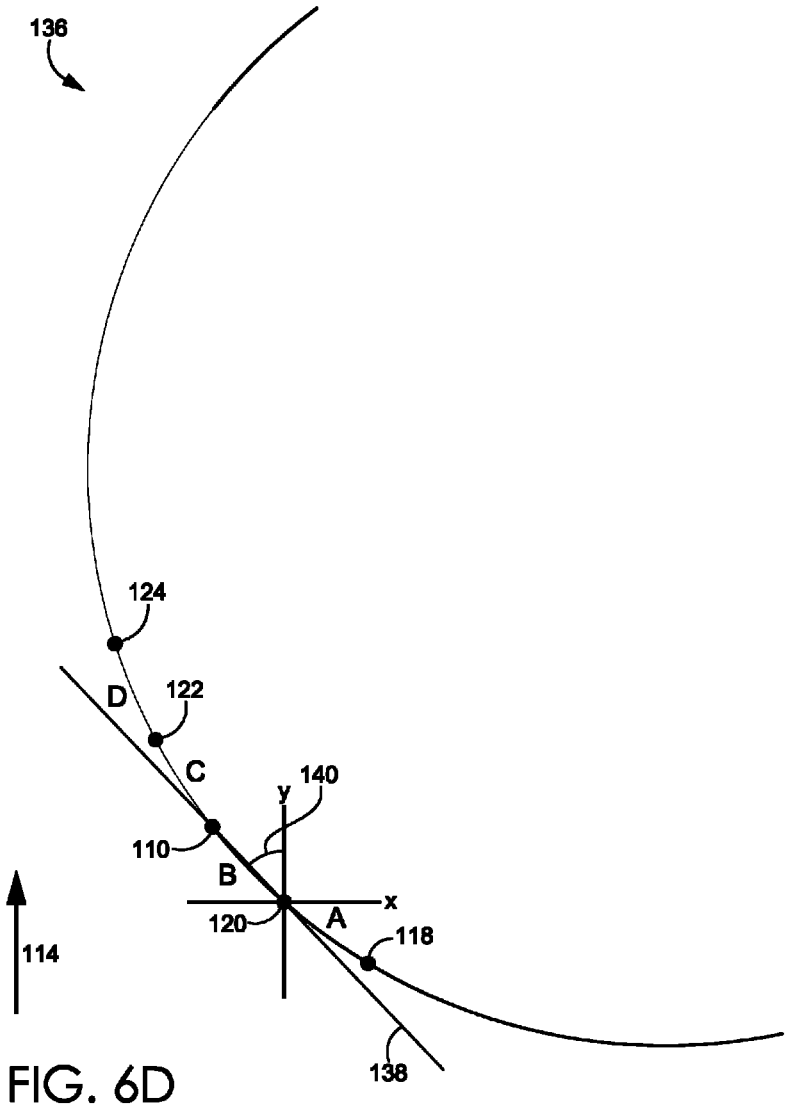
FIG. 6D is an enlarged portion of the exemplary pattern of FIG. 6A, sewn with a variable stitch density, in accordance with an embodiment of the invention.

Turning now to FIG. 6D, an enlarged portion 136 of the exemplary pattern 98 of FIG. 6A further depicts an embodiment of determining stitch density for sewing. For increment B, an x- and y-axis positioned at point 120 may be used to determine an angle 140 of the increment B with respect to the axis 114. In other words, with a line 138 drawn between points 120 and 110, an angle 140 of the increment B may be determined relative to the axis 114 (shown parallel to the y-axis at point 120). In one embodiment, based on an evaluation of the angle 134 of increment A, and the angle 140 of increment B, when angle 134 and angle 140 satisfy a threshold angle with respect to an axis 114, a determination may be made whether the entire portion of the arc segment between points 118 and 110 satisfies a threshold angle with respect to the axis 114. In the embodiment of FIG. 6D, increment B may be positioned at an angle greater than the threshold amount from the axis 114, and therefore increment B may be assigned a standard stitch density.

Similarly, the angles of increments C and D may be individually determined relative to the axis 114, and used to determine the assignment of either a standard stitch density or an altered stitch density. In embodiments, upon determination that two adjacent and/or consecutive increments of the arc segment satisfy a particular threshold angle with respect to the axis 114, both increments may be assigned an altered stitch density when the threshold length of the combined increments may further be satisfied (referenced in FIG. 6B). Accordingly, in the example of FIGS. 6C-6D, with angle 134 and angle 140 greater than the threshold angle value from the y-axis (i.e., relative to the axis 114), neither increment may be assigned an altered stitch density. As such, in the embodiment of FIGS. 6C-6D, increments A and B are depicted as having been assigned a standard stitch density for sewing. In some embodiments, a standard stitch density may be assigned to all portions of a sewing pattern, such as a "default" assigned stitch density. Accordingly, in embodiments, only those portions of the pattern that satisfy both of the applicable thresholds, with respect to a threshold angle and a threshold sewing distance, may qualify for sewing with an altered stitch density, such as a stitch density lower than an existing and/or standard stitch density for a pattern. In one embodiment, the threshold angle from the axis 114 is 40 degrees or less.

Figure 6E:
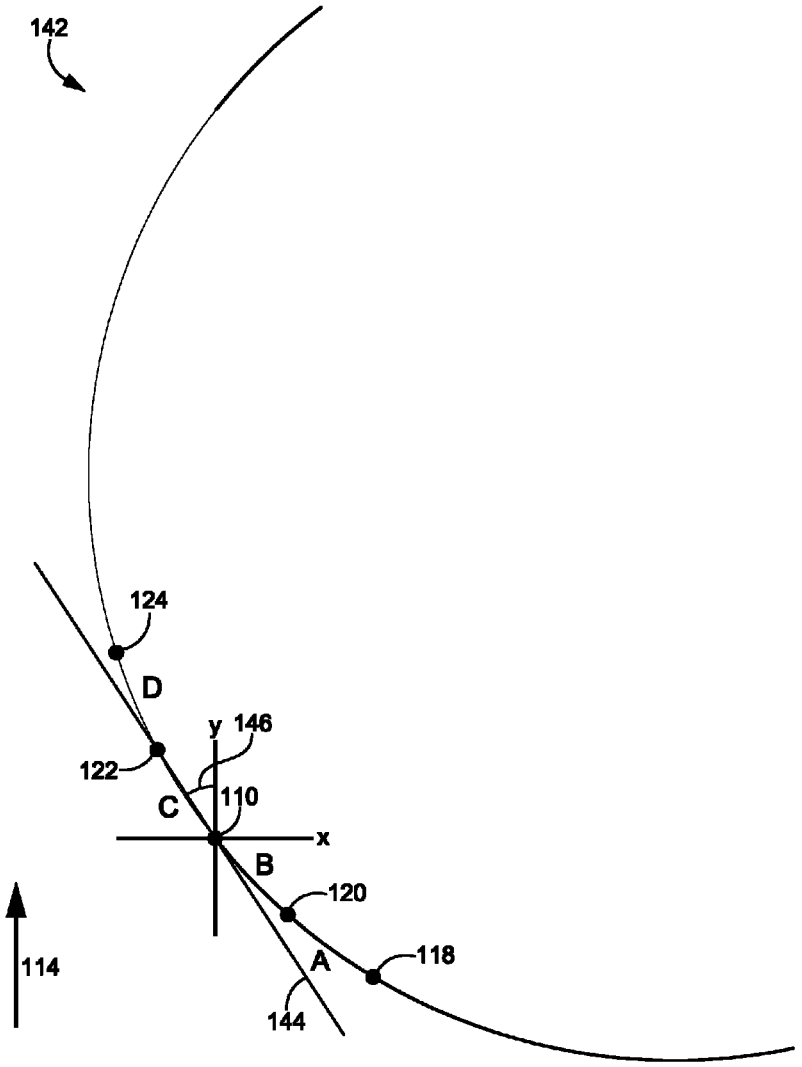
FIG. 6E is an enlarged portion of the exemplary pattern of FIG. 6A, sewn with a variable stitch density, in accordance with an embodiment of the invention.

Turning now to FIG. 6E, an enlarged portion 142 of the exemplary pattern 98 of FIG. 6A includes an example of determining stitch density within elements of a pattern, in accordance with an embodiment of the invention. FIG. 6E depicts a similar determination as that discussed above with respect to increments A and B in FIGS. 6C and 6D, respectively. However, as shown in FIG. 6E, with the x-axis and y-axis positioned at point 110, a line 144 spanning from point 110 to point 122 may be determined to have and/or form a particular angle 146 with respect to the axis 114 (e.g., where axis 114 is parallel to the y-axis at point 110) that may not satisfy the threshold angle. In one embodiment, it may be determined that increment C satisfies the threshold angle with respect to the axis 114. In one embodiment, angle 146 may be less than the threshold angle value (e.g., less than 40 degrees from the axis 114) and may therefore be assigned an altered stitch density upon satisfaction of additional thresholds. For example, in some embodiments, at least two consecutive increments and/or a threshold number of increments may satisfy the threshold angle with respect to the axis 114 in order to qualify for an altered stitch density (i.e., for "wild stitch") determination and/or assignment. As such, in further embodiments, in addition to a threshold number of increments satisfying the threshold angle with respect to the axis 114, a portion of an arc segment may also satisfy a threshold sewing distance prior to a determination that the portion of the arc segment may be assigned an altered stitch density. In one embodiment of the invention satisfying such determination, the portion of the arc segment may generally include one or more adjacent and/or consecutive increments satisfying the threshold angle.

Figure 6F:
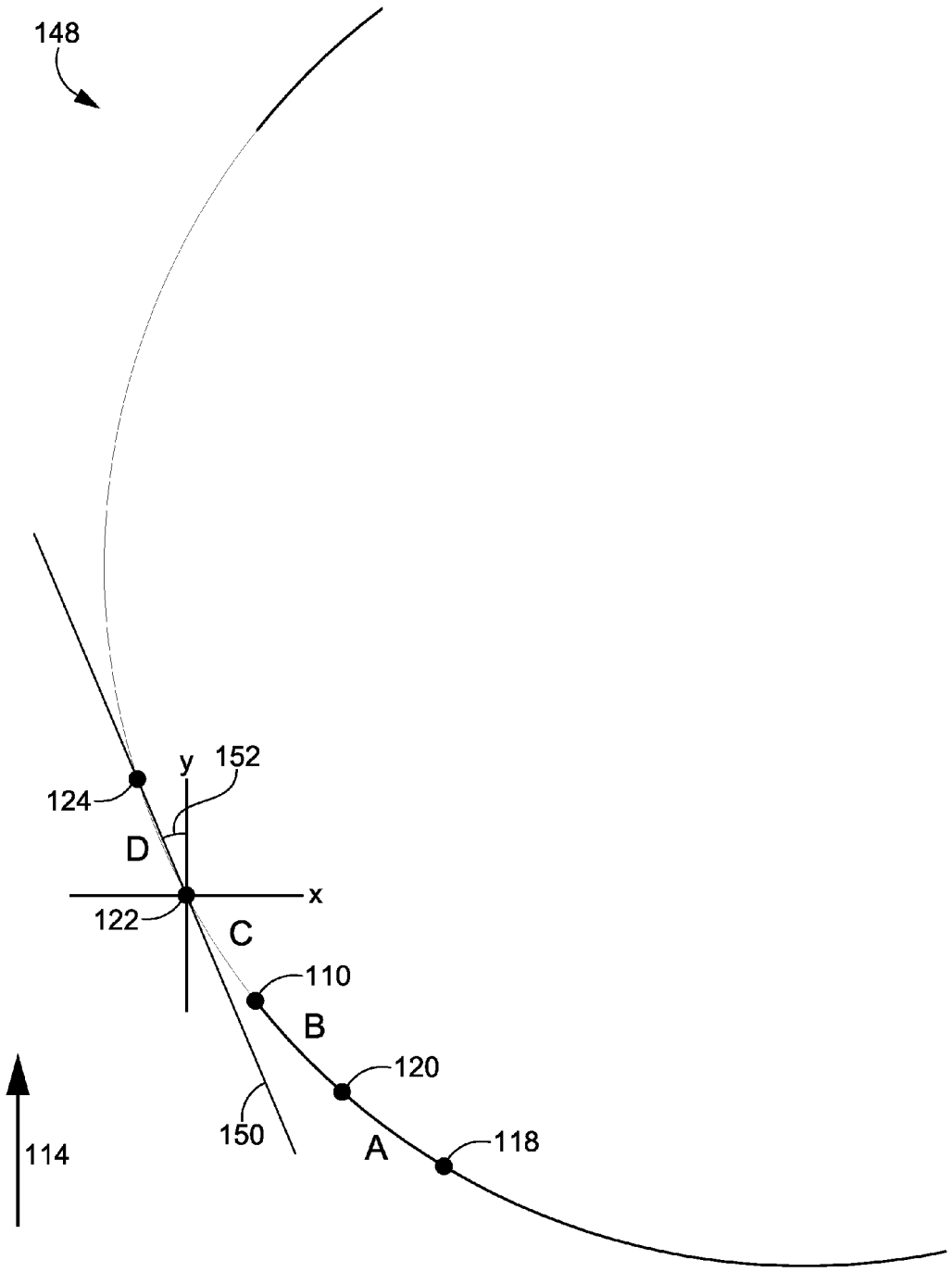
FIG. 6F is an enlarged portion of the exemplary pattern of FIG. 6A, sewn with a variable stitch density, in accordance with an embodiment of the invention.

Accordingly, FIG. 6F includes an enlarged portion 148 of the exemplary pattern 98 of FIG. 6A, for determining stitch density for sewing. In embodiments, upon determining that increment C satisfies the threshold angle with respect to the axis 114, a determination may be made in exemplary FIG. 6F regarding whether increment D also satisfies the threshold angle. As shown in FIG. 6F, the intersection of an x-axis and y-axis are depicted as positioned at point 122 while a line 150 is drawn between points 122 and 124 (e.g., the line 150 spans from point 122 to point 124) may be measured with respect to the y-axis (e.g., where y-axis is parallel to the axis 114). As shown in FIG. 6F, the angle 152 between line 150 and the y-axis demonstrates the angle of increment D with respect to the axis 114. In the embodiment shown in FIG. 6F, with the x-axis and y-axis positioned at point 122, a line 150 between points 122 and 124 may be determined to provide a particular angle 152 that satisfies the threshold angle with respect to the axis 114. In one embodiment, both increments C and D may be determined to satisfy the threshold angle with respect to the axis 114 and the segment portion between point 110 and 124 may be assigned an altered stitch density based on the satisfaction of the threshold angle by both increments C and D.

Figure 8:
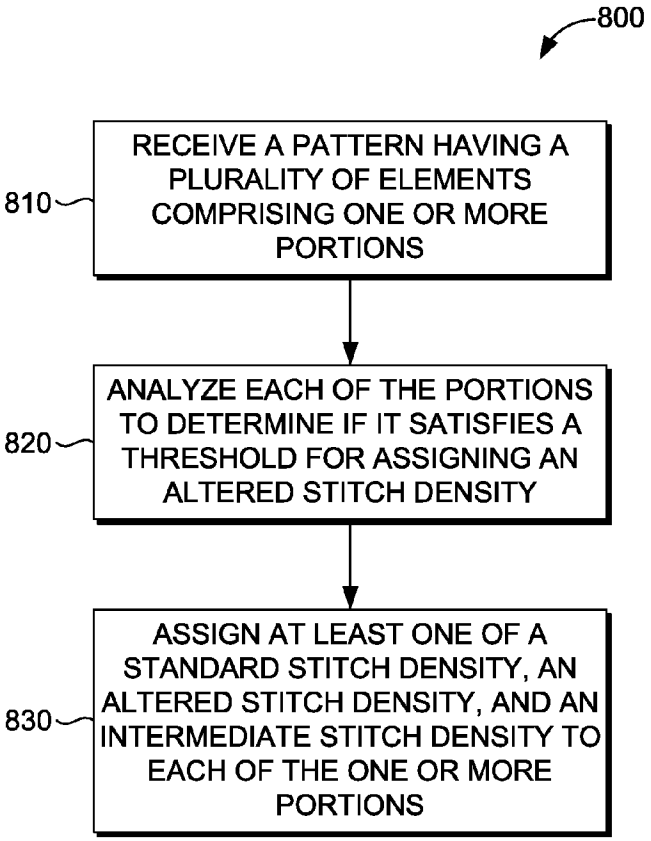
FIG. 8 is a flow diagram of an exemplary method of sewing a pattern using a variable stitch density, in accordance with an embodiment of the invention.
Figure 7:
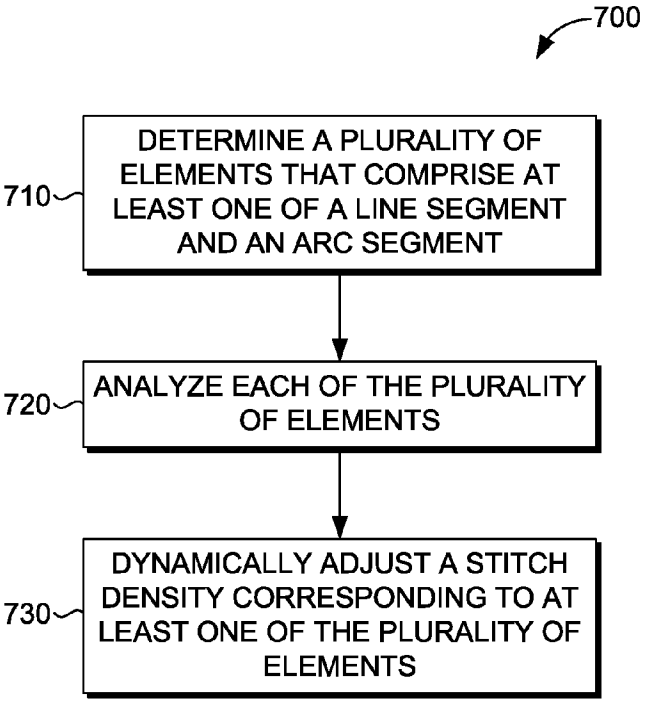
FIG. 7 is a flow diagram of an exemplary method of sewing a pattern using a variable stitch density, in accordance with an embodiment of the invention.
Figure 9:
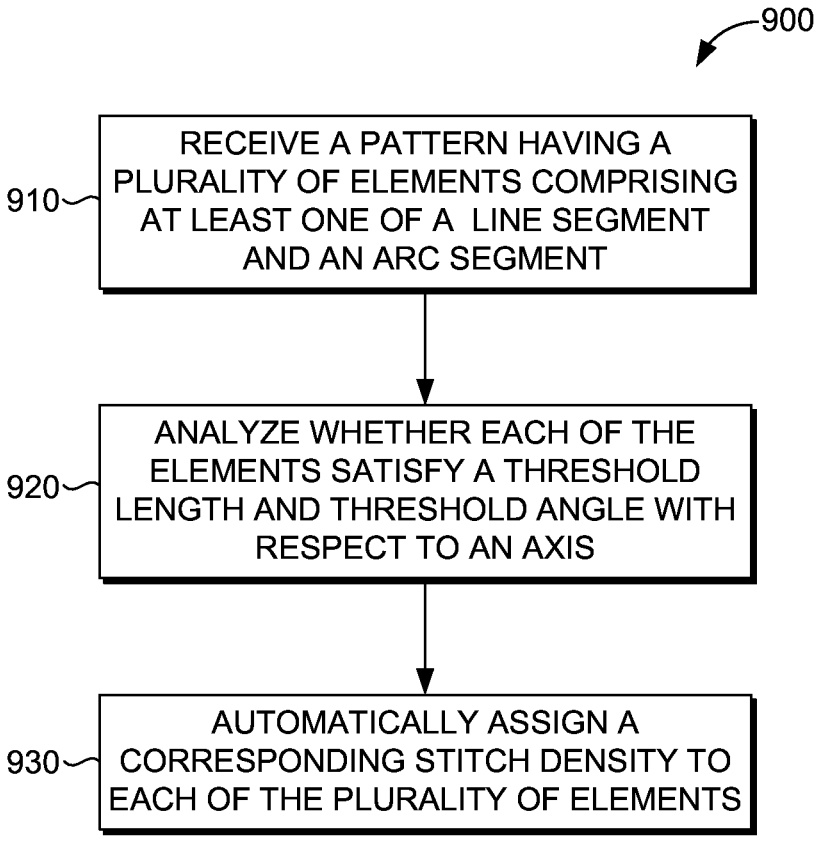
FIG. 9 is a flow diagram of an exemplary method of sewing a pattern using a variable stitch density, in accordance with an embodiment of the invention.

With reference now to FIGS. 7-9, exemplary flow diagrams depict embodiments of methods for dynamically changing stitch density within a pattern. These exemplary methods can be described in the general context of computer executable instructions, in further embodiments. Generally, computer executable instructions can include routines, programs, objects, components, data structures, procedures, modules, functions, and the like that perform particular functions or implement particular abstract data types. The methods can also be practiced in a distributed computing environment where functions are performed by remote processing devices that are linked through a communication network or a communication cloud. In a distributed computing environment, computer executable instructions may be located both in local and remote computer storage media, including memory storage devices.

The exemplary methods are illustrated as a collection of blocks in a logical flow graph representing a sequence of operations that can be implemented in hardware, software, firmware, or a combination thereof. The order in which the methods are described is not intended to be construed as a limitation, and any number of the described method blocks can be combined in any order to implement the methods, or alternate methods. Additionally, individual operations may be omitted from the methods without departing from the spirit and scope of the subject matter described herein. In the context of software, the blocks represent computer instructions that, when executed by one or more processors, perform the recited operations. The methods described herein are not presented in the context of a device or computer software for ease of illustration. The description should not be construed to limit the performance of the methods in the absence of a device and/or software, or construed to limit the performance of the methods to particular devices and/or computer software.

Beginning with the embodiment of FIG. 7, an illustrative method 700 for dynamically changing stitch density along an axis of a sewing pattern is provided. Initially, at block 710, the method includes determining a plurality of elements of a sewing pattern, the plurality of elements comprising at least one of one or more line segments and one or more arc segments.

Next, at block 720, each of the one or more line segments and one or more arc segments are analyzed. In one embodiment of the invention, the analysis of one or more arc segments of the sewing pattern occurs automatically, without user intervention, to apply embodiments of the invention to at least a portion of a sewing pattern. In an alternative embodiment, the analysis may be enabled by user interaction. In some embodiments, analyzing each of the one or more line segments may include determining whether at least a portion of each of the one or more line segments satisfies 1) a threshold length between a line segment start point and a line segment stop point of each portion of each of the one or more line segments and 2) a threshold angle with respect to an axis. In further embodiments, analyzing each of the one or more line segments may include assigning an adjusted stitch density to each portion of each of the one or more line segments that satisfies the threshold length and the threshold angle. In yet further embodiments, analyzing each of the one or more line segments may include assigning a standard stitch density to each portion of each of the one or more line segments that does not satisfy one or more of a threshold length between a line segment start point and a line segment stop point, and a threshold angle with respect to the axis. In some aspects of the present invention, the axis may be a feed axis or a carriage axis.

In some embodiments, the analysis of each of the one or more arc segments comprises interpolating each of the one or more arc segments to provide a plurality of increments for each arc segment. Then, a first portion of a first arc segment of the one or more arc segments is analyzed. The first portion may generally include a first increment and a second increment of the plurality of increments. In embodiments, the first increment may be adjacent the second increment such that the first increment may be sewn immediately prior to the second increment. In yet further embodiments, analyzing a first portion of a first arc segment of the one or more arc segments includes analyzing the first increment having a first increment start point and a first increment stop point. Further, analyzing the first increment may include determining that the first increment satisfies a threshold angle with respect to the axis. And, analyzing the second increment having a second increment start point and a second increment stop point may include determining that the second increment satisfies the threshold angle with respect to the axis. In embodiments, upon determining that both the first increment and the second increment satisfy the threshold angle with respect to the axis, the analysis may include determining that the total length of the first increment and the second increment also satisfy a threshold length. Based on the analysis of the first and second increments and having determined that both the first and second increments satisfy a threshold angle with respect to the axis and a threshold length, an adjusted stitch density may be assigned to the first portion.

In further embodiments, the analysis of each of the one or more arc segments may be performed. In such embodiments, the analysis may include analyzing a second portion of the first arc segment of the one or more arc segments. The second portion may include a third increment and a fourth increment of the one or more of increments. Additionally, in embodiments, the third increment may be adjacent to the fourth increment such that the third increment is located such that the third increment may be sewn just prior to sewing of the fourth increment. Alternatively, the third increment might be placed such that the third increment may be sewn immediately after the fourth increment is sewn. Additionally, the analysis of each of the one or more arc segments might include analyzing the third increment having a third increment start point and a third increment stop point. Analyzing the third increment may include determining that the third increment satisfies a threshold angle with respect to the axis. Further still, said analysis might further include analyzing the fourth increment having a fourth increment start point and a fourth increment stop point. Analyzing the fourth increment may include determining whether the fourth increment satisfies the threshold angle with respect to the axis. And, upon determining that the fourth increment may not satisfy the threshold angle with respect to the axis, a standard stitch density may be assigned to the second portion.

Having analyzed such elements, at block 730, the stitch density is dynamically adjusted. Dynamically adjusting the stitch density (e.g., for at least one of the plurality of elements) comprises assigning an adjusted stitch density to at least one of the plurality of elements based on the analysis of each of the one or more line segments and one or more arc segments. In further embodiments, the method 700 might also comprise identifying a stitch density of two or more adjacent elements and assigning an intermediate stitch density to at least a portion of the sewing pattern.

As discussed above, in some embodiments, a portion of a first element of a pattern may be sewn using a first stitch density while a second portion of the first element may be sewn using a second stitch density. As such, particular portions of a single element may vary in stitch density (e.g., including more than one different stitch density), where the single element includes more than one angle with respect to the axis. FIG. 6A may be generally referred to hereinafter for illustrative purposes only, and should not be construed as limiting the method 700 in any way. As previously shown in exemplary FIG. 6A, a single arc segment "element" may include multiple different portions that, upon comparison to the applicable thresholds of the present invention, vary in assigned stitch density. For example, while first portion 102 includes a standard stitch density 104, as the arc segment is lengthened along the axis 114, second portion 106 may be assigned an altered stitch density 108 based on the satisfaction of one or more thresholds.

At FIG. 8, a flow diagram of a method 800 for automatically adjusting stitch density between elements of a sewing pattern for sewing along an axis is shown. The method 800 comprises receiving a pattern having a plurality of pattern elements, wherein each of the plurality of pattern elements comprises one or more portions at block 810. In some embodiments, the plurality of pattern elements comprises one or more line segments. Additionally or alternatively, the plurality of pattern elements may also comprise one or more arc segments, wherein each of the one or more arc segments further comprises one or more increments.

Next, at block 820, the method 800 includes analyzing each of the one or more portions of the plurality of pattern elements to determine whether each of the plurality of pattern elements satisfies a threshold for assigning an altered stitch density to at least one portion of the plurality of pattern elements. In one embodiment, analyzing each of the plurality of pattern elements comprises determining whether a portion of each of the one or more line segments satisfies a threshold length and determining whether each portion of each of the one or more line segments that satisfies the threshold length further satisfies a threshold angle with respect to the axis. In another embodiment, analyzing each of the plurality of pattern elements comprises determining whether each increment of each of the one or more arc segments satisfies a threshold angle with respect to an axis and determining whether each increment of each of the one or more arc segments that satisfies the threshold angle with respect to the axis further satisfies a threshold length. In further embodiments, determining whether each increment of each of the one or more arc segments that satisfies the threshold angle with respect to the axis and satisfies a threshold length further comprises determining there is a plurality of adjacent increments that satisfy the threshold angle, each of the plurality of adjacent increments comprising an increment start point and an increment stop point, and determining whether the summed length of the plurality of adjacent increments that satisfy the threshold angle with respect to the axis satisfies a threshold length.

Turning to block 830, the method 800 further comprises assigning at least one of a standard stitch density, an altered stitch density, and an intermediate stitch density to each of the one or more portions of the plurality of pattern elements. In some embodiments, each portion of the one or more line segments comprises a line segment start point and a line segment stop point, wherein the threshold length comprises a sewing distance between the line segment start point and the line segment stop point for each portion of the one or more line segments.

Referring to FIG. 9, method 900 includes multiple, exemplary steps for dynamically changing stitch density within a sewing pattern and automatically assigning variable stitch densities to pattern elements of a sewing pattern. Embodiments of the invention include receiving a sewing pattern having a plurality of pattern elements, wherein the plurality of pattern elements comprises at least one of one or more line segments and one or more arc segments, at block 910.

Once the sewing is received, the method 900 includes, at block 920, analyzing each of the plurality of pattern elements to determine whether at least a portion of each of the plurality of pattern elements satisfies a threshold length and a threshold angle with respect to an axis. In some embodiments, each of the one or more line segments comprises a line segment start point and a line segment stop point, and further, analyzing each of the plurality of pattern elements comprises determining whether each of the one or more line segments satisfies a threshold angle with respect to the axis and determining whether at least a portion of each of the one or more line segments satisfies a threshold length based on a sewing distance between the line segment start point and the line segment stop point. In some embodiments, each of the one or more arc segments comprises an arc segment start point and an arc segment stop point, wherein analyzing each of the plurality of pattern elements comprises determining whether at least a portion of each of the one or more arc segments satisfies a threshold angle with respect to the axis and determining whether the one or more arc segments satisfies a threshold length based on a sewing distance between the arc segment start point and the arc segment stop point.

In some aspects, determining whether at least a portion of each of the one or more arc segments satisfies a threshold angle with respect to the axis comprises determining a plurality of increments for each of the one or more arc segments, each of the plurality of increments comprising an increment start point and an increment stop point. Once said increments are determined, for a first increment of a first arc segment of the one or more arc segments, the method 900 might further include determining that the first increment satisfies the threshold angle with respect to the axis based on a first increment start point and a first increment stop point and for a second increment of the first arc segment of the one or more arc segments, determining whether the second increment satisfies the threshold angle with respect to the axis based on a second increment start point and a second increment stop point.

Continuing with FIG. 9, at block 930, the method 900 further includes automatically assigning a corresponding stitch density to each of the plurality of pattern elements based on the analysis. In some embodiments, upon determining that the second increment satisfies the threshold angle, and upon determining the first increment and second increment satisfy a threshold length based on a sewing distance between the first increment start point and the second increment stop point, the method 900 includes assigning an altered stitch density to the first increment and the second increment. In yet further embodiments, upon determining that the second increment does not satisfy the threshold angle, the method 900 includes assigning a standard stitch density to the first increment and the second increment.

Figure 10:
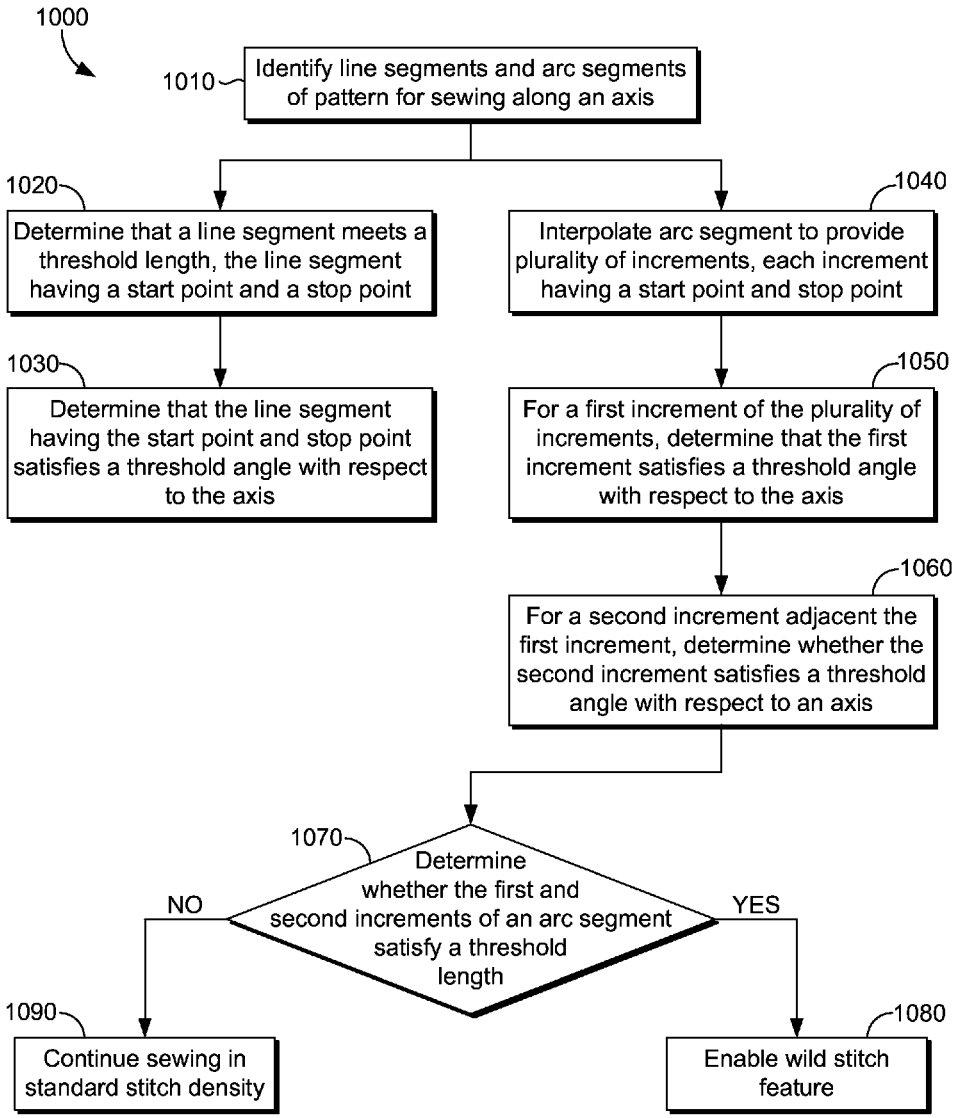
FIG. 10 is a flow diagram of an exemplary method of sewing a pattern using a variable stitch density, in accordance with an embodiment of the invention.

FIG. 10 illustrates a flow diagram 1000 that includes multiple, exemplary steps for dynamically changing stitch density within a sewing pattern. At block 1010, embodiments of the invention include identifying pattern elements, such as line segments and arc segments of a pattern, for sewing along an axis. At block 1020, an analysis of each identified line segment (from block 1010) includes a determination that the line segment meets a threshold length, with the line segment having a start point and a stop point. For example, a portion of a sewing pattern may be identified as including a line segment, which is then identified according to a start point and stop point for determining a sewing distance over which a particular stitch density may be assigned. In some embodiments, the threshold length for sewing a line segment is at least one half of an inch. In further embodiments, the threshold length for sewing a line segment may be an inch of sewing distance along the line segment. Upon satisfying the threshold length determination, at block 1030, a determination is made as to whether the line segment, having the start point and stop point, satisfies a threshold angle with respect to the axis. As noted above with respect to FIG. 5, although a portion of a pattern may include a line segment that satisfies a threshold length, the segment may also satisfy a threshold angle with respect to the axis in order to qualify for sewing with an altered stitch density. As such, multiple line segments of FIG. 5 are depicted as having been sewn with a standard stitch density 88, even though several of such segments satisfy a threshold sewing distance.

Turning next to the determinations with respect to arc segments, at block 1040, the arc segment is interpolated to provide a plurality of increments, each increment having a start point and a stop point. As such, each start point and stop point may be used to determine a threshold angle of each increment with respect to the axis. At block 1050, for a first increment of the plurality of increments, a determination may be made as to whether the first increment satisfies a threshold angle with respect to the axis. Upon determining that a first increment satisfies the threshold angle, at block 1060, a second increment may be considered. In particular, at block 1060, a second increment adjacent or consecutive with the first increment may be analyzed to determine whether the second increment satisfies a threshold angle with respect to the axis. At block 1070, if the second increment also satisfies the threshold angle with respect to the axis, it may next be determined, via analysis, whether the first and second increments, together, satisfy a threshold length. If the increments satisfy the threshold length, then at block 1080, the wild stitch feature may be enabled (i.e., an altered stitch density may be assigned to both the first and second increments). At block 1090, if the second increment does not satisfy the threshold angle, the sewing pattern continues with using the standard stitch density.

Figure 11:
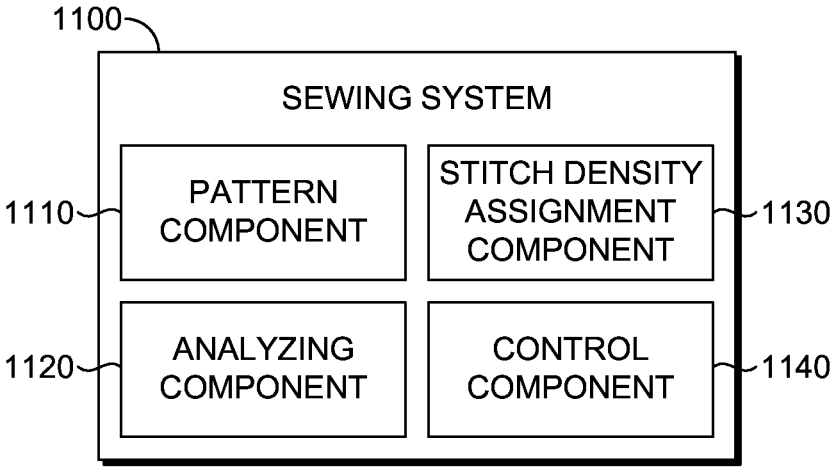
FIG. 11 is an exemplary system for sewing a pattern using a variable stitch density, in accordance with an embodiment of the invention.

An exemplary sewing system in which various aspects of the present invention may be implemented is described below in order to provide a general context for various aspects of the present invention. Referring to FIG. 11, an illustrative system for implementing embodiments of the present invention is shown and designated generally as sewing system 1100. The sewing system 1100 shown in FIG. 11 is an example of one suitable system and is not intended to suggest any limitation as to the scope of use or functionality of embodiments of the inventions disclosed throughout this document. Neither should the exemplary system 1100 be interpreted as having any dependency or requirement related to any single component or combination of components illustrated therein. For example, the analyzing component 1120 and the stitch density assignment component 1130 may be integrated in a single component or may directly communicate with one another. And although the system 1100 is depicted as a group of integrated components, the system 1100 may actually be distributed over a network and one or more devices such that the components depicted, for example. The components depicted may communicate directly or indirectly with one another, independent of said components' being integrated into a single system or device, or distributed across a network and more than one device.

It will be understood by those of ordinary skill in the art that the components illustrated in FIG. 11 are exemplary in nature and in number and should not be construed as limiting. Any number of components/modules may be employed to achieve the desired functionality within the scope of embodiments hereof. Further, components/modules may be located on any number of computing devices.

The sewing system 1100 of FIG. 11 includes a pattern component 1110, an analyzing component 1120, a stitch density assignment component 1130, and a control component 1140, in embodiments. General reference to illustrative FIG. 3 is made herein merely to clarify the operations of the system 1100, the components, and the function of the components described below. FIG. 3 and the description of FIG. 3 above should not be construed as limiting or narrowing the sewing system 1100 of FIG. 11 and any claims corresponding to sewing system 1100 in any way. Reference to FIG. 3 is for illustrative purposes only. Further, the system 1100 of FIG. 11 should not be construed as having any dependency or limited to the exemplary pattern sewn with a variable stitch density depicted in FIG. 3.

The pattern component 1110 may be generally configured to receive an indication of a sewing pattern, such as exemplary sewing pattern 42 of FIG. 3. In some embodiments, the pattern component may be communicatively coupled to a database (not shown) that stores one or more sewing patterns. The analyzing component 1120 may be configured to analyze a sewing pattern. Analysis of a sewing pattern may include identification of one or more elements of a sewing pattern. For example, the analyzing component 1120 may identify one or more elements such as exemplary first element 54, second element 56, third element 58, fourth element 60 and fifth element 52. One or more identified elements may be analyzed to determine whether at least one of the one or more elements satisfies an applicable threshold (e.g., threshold angle or threshold length). When one or more applicable thresholds are determined to be satisfied for an element, it may further be determined that the element may be sewn with a particular stitch density (e.g., "wild" stitch density).

The analyzing component 1120 may also make determinations beyond a threshold analysis. For example, the analyzing component 1120 may determine one elements position relative to another element within a pattern. Using illustrative FIG. 3 for reference, exemplary first element 54 is depicted as adjacent and continuous with second element 56, whereas first element 54 is depicted as non-adjacent and not continuous with third element 58. The analyzing component 1120 might be configured to determine that first element 54 is adjacent and continuous with second element 56, in embodiments. Further, the analyzing component 1120 may be configured to identify characteristics of elements in a pattern. The analyzing component 1120 might further be configured to compare characteristics of elements in a pattern for similarities and/or differences. For example, the analyzing component 1120 may determine that the first element 54 has different characteristics than the second elements 56. Characteristics might include an overall shape, a curvature, a lack of curvature, a size, a yardage (e.g. the amount of thread yardage to be used when the element is sewn using a standard stitch density), a yardage length range (e.g., the amount of thread yardage to be used when the smallest stitch density is used to sew the element up to the amount of thread yardage to be used when the largest stitch density is used to sew the element), etc. Thread yardage may be an estimate determined by the analyzing component 1120. The analyzing component 1120 may further determine that the first element 54 has same or similar characteristics as the third element 58 and the fifth element 52, for example.

Each element may be analyzed one at a time, analyzed in a sequential manner (e.g., first element is analyzed prior to the second element, second element is analyzed prior to the third element), or analyzed concurrently by the analyzing component 1120. In a further embodiment, elements having characteristics that are the same or similar may be analyzed together (e.g., one or more elements identified as having a curvature are analyzed together while one or more elements identified as being straight are analyzed together). Analyzing elements that have same or similar characteristics may facilitate increased accuracy of stitch density determinations by the analyzing component 1120. For example, the analyzing component 1120 analyzes the exemplary second element 56 and fourth element 60, and determines that the second element 56 has a different curvature, as depicted in exemplary FIG. 3. When the curvature is of the second element 56 is found to be greater than the fourth element 60, for example, the stitch density of the second element 56 may be determined to be different than the fourth element 60, even though both the second and fourth elements 56 and 58 share similar characteristics relative to other elements, such as third element 58, for example. As such, accuracy and detailed results of an analysis performed by the analyzing component 1120 may be increased and/or improved by comparison of elements in a pattern. In further embodiments, the analyzing component 1120 might reference a database of patterns and/or previous analysis results for one or more other patterns, which may be used by the analyzing component 1120 to analyze a current pattern.

In yet further embodiments, the analyzing component 1120 may determine a threshold sewing distance, a threshold length, and/or a threshold angle based on the analysis of the pattern and/or elements of the pattern. The analyzing component 1120 may, alternatively, apply one or more predetermined or predefined thresholds when performing the analysis of the pattern and/or elements of the pattern. For example, a predetermined threshold sewing distance may be communicated to the system with a corresponding sewing pattern. In another example, the analyzing component 1120 may reference a database to identify one or more predetermined thresholds for the analysis of a sewing pattern.

Based on the analysis performed by the analyzing component 1120, the stitch density assignment component 1130 may assign a stitch density to one or more elements of a sewing pattern. The stitch density assignment component 1130 may receive an indication of one or more stitch densities (e.g., analysis results including characteristics, threshold satisfaction) that may have been identified by the analyzing component 1120 based on the analysis of the pattern and/or elements therein. Additionally and/or alternatively, the stitch density assignment component 1130 may receive an indication of one or more elements that satisfy a threshold angle and one or more elements that may not satisfy a threshold angle. Additionally and/or alternatively, the stitch density assignment component 1130 may receive an indication of one or more elements that satisfy a threshold length and one or more elements that may not satisfy a threshold length. Additionally and/or alternatively, the stitch density assignment component 1130 may receive an indication of one or more elements that satisfy a threshold sewing distance and one or more elements that may not satisfy a threshold sewing distance. Any number and combination of indications for applicable thresholds and analysis results are contemplated to be within the scope of this invention.

Based on the received indications regarding one or more elements of a sewing pattern, the stitch density assignment component 1130 may assign a stitch density to each element of a sewing pattern. For elements, such as line segments that are determined to satisfy a threshold angle, the stitch density assignment component 1130 may assign an altered stitch density (e.g., "wild stitch" density). For elements, such as arc segments that are determined to satisfy a threshold length, the stitch density assignment component 1130, may assign an altered stitch density (e.g., "wild stitch" density). For elements that were determined to satisfy a threshold length, the stitch density assignment component 1130 may assign may assign an altered stitch density (e.g., "wild stitch" density). In further embodiments, the stitch density assignment component 1130 may assign an altered stitch density to elements that satisfy both a threshold angle and a threshold length, or both a threshold length and threshold sewing distance, or other combination. Additionally and/or alternatively, the stitch density assignment component 1130 may assign an altered stitch density to elements that satisfy a threshold angle but that do not satisfy a threshold length, or elements that satisfy both a threshold length and a threshold angle. Any number and/or combination of thresholds determined during analysis are considered to be within the scope of this disclosure for the purposes of the stitch density assignment component 1130.

The control component 1140 may communicate the one or more of the sewing pattern, the elements, and/or the stitch densities assigned to each of the elements to a computing device and/or a sewing machine for execution. The control component 1140 may also execute sewing the pattern using the assigned stitch densities in real time. For example, when sewing a pattern in real time, the control component 1140 dynamically changes stitch density on an element-by-element basis based on the assigned stitch densities. The control component 1140 may execute the pattern and change between one or more stitch densities automatically, based on the stitch densities assigned to elements by the stitch density assignment component 1130. It will be understood to those in the art that the control component 1140 may provide indications and/or instructions to a sewing machine and/or computing device in order to effectuate dynamic changes in stitch density of a sewing pattern. As such, the control component 1140 may be communicatively coupled, directly or indirectly, with other components not depicted in FIG. 11, whether local to the system 1100 or remote.

Further embodiments of the system 1100 may include components not depicted in FIG. 11. For example, the system 1100 might include a receiving component that receive a sewing pattern and/or downloads a sewing pattern from a data source, website, or application. A receiving component might further receive sewing machine specifications that act as input and/or guidelines for the analysis performed by the analyzing component's 1120 and/or the stitch density assignment component 1130. Sewing machine settings and/or other device settings may be received by a receiving component in further embodiments. One or more of the components of the system 1100 might utilize such settings in performing corresponding functions described herein.

The system 1100 might include a communication component that communicates instructions to a computing device and/or a sewing machine, in yet further embodiments. A communication component might translate information, received from a control component 1140, into instructions. Instructions may describe the assigned stitch density for each element in a sewing pattern. The communication component may translate instructions received from the control component 1140 into a machine-readable language and/or a computer-readable language. It will be understood and each and every component described herein may communicate directly or indirectly with every other component described herein.

Figure 12:
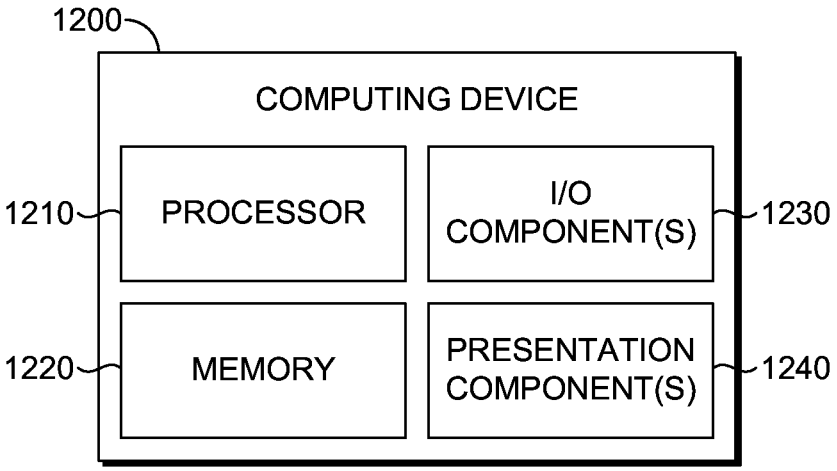
FIG. 12 is an exemplary device for sewing a pattern using a variable stitch density, in accordance with an embodiment of the invention.

At FIG. 12, a computing device 1200 is provided in which a sewing system, such as exemplary sewing system 1100, may be implemented using or with which a sewing system may be communicatively coupled. The exemplary computing device 1200 includes a processor 1210, a memory 1220, I/O component(s) 1230, and a presentation component 1240, in embodiments. Although the various blocks of FIG. 12 are shown as discrete components for the sake of clarity, in reality, delineating various components is not so clear, and metaphorically, the boxes would more accurately be gray and fuzzy. For example, one may consider a presentation component such as a display device to be an I/O component. Also, processors have memory. The inventors recognize that such is the nature of the art, and reiterate that the diagram of FIG. 12 is merely illustrative of an exemplary computing device that can be used in connection with one or more embodiments of the present invention. Distinction is not made between such categories as "workstation," "server," "laptop," "hand-held device," "tablet," etc., as all are contemplated within the scope of FIG. 12 and reference to "computing device."

The memory 1220 includes computer-executable instructions (not shown) stored in volatile and/or nonvolatile memory. The memory 1220 may be removable, non-removable, or a combination thereof. Exemplary hardware devices include solid-state memory, hard drives, optical-disc drives, etc. The memory 1220 is an example of computer readable media. Computer-readable media includes at least two types of computer readable media, namely computer storage media and communications media.

The computing device 1200 typically includes a variety of computer-readable media. Computer-readable media may be any available media that is accessible by the computing device 1200 and includes both volatile and nonvolatile media, removable and non-removable media. Computer-readable media comprises computer storage media and communication media, computer storage media excluding signals per se. Computer storage media includes volatile and nonvolatile, removable and non-removable media implemented in any method or technology for storage of information such as computer-readable instructions, data structures, program modules, or other data. Computer storage media includes, but is not limited to, RAM, ROM, EEPROM, flash memory or other memory technology, CD-ROM, digital versatile disks (DVDs) or other optical disk storage, magnetic cassettes, magnetic tape, magnetic disk storage or other magnetic storage devices, or any other medium that can be used to store the desired information and that can be accessed by computing device 110.

Communication media, on the other hand, embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer-readable media.

The computing device 1200 includes one or more processors (e.g., 1210) that read data from various entities such as the memory 1220 or I/O components 1230. In an embodiment, the one or more processors 1210 execute the computer-executable instructions to perform various tasks and methods defined by the computer-executable instructions. The presentation component(s) 1240 present data indications to a user or other device. Exemplary presentation components include a display device, speaker, printing component, and the like.

Illustrative I/O components 1230 include a microphone, joystick, game pad, scanner, printer, wireless device, a controller, a stylus, a keyboard, a mouse, a voice input device, a touch-input device, a touch-screen device, an interactive display device, a natural user interface (NUI), and the like. The I/O components 1230 may be communicatively connected to the computing device 1200 and/or to remote devices such as, for example, other computing devices, servers, routers, and the like via a networking environment (e.g., Wireless Fidelity, Bluetooth, or Ethernet).

Various aspects of embodiments of the invention may be described in the general context of computer program products that include computer code or machine-useable instructions, including computer-executable instructions such as program modules, being executed by a computer or other machine, such as a personal data assistant or other computing device. Generally, program modules including routines, programs, objects, components, data structures, etc., refer to code that perform particular tasks or implement particular data types. Embodiments of the invention may be practiced in a variety of configurations, including dedicated servers, general-purpose computers, laptops, more specialty computing devices, and the like. The invention may also be practiced in distributed computing environments where tasks are performed by remote-processing devices that are linked through a communications network.

It will be understood that the methods of and systems for dynamically changing stitch density may be embodied as computer-executable instructions stored on computer-readable media (e.g., computer storage media) such that the computer-executable instructions may be executed by one or more processors and a memory, the execution of which results in performance of the methods and systems described herein.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A method for dynamically changing stitch density along an axis of a sewing pattern, the method comprising:

determining a plurality of elements of a sewing pattern, the plurality of elements comprising at least one of one or more line segments and one or more arc segments;

analyzing each of the one or more line segments and one or more arc segments, wherein analyzing includes determining whether each of the one or more line segments and one or more arc segments satisfies a threshold length and a threshold angle with respect to an axis; and dynamically adjusting a stitch density corresponding to at least one of the plurality of elements, wherein dynamically adjusting the stitch density comprises assigning an adjusted stitch density to at least one of the plurality of elements that satisfies the threshold length and the threshold angle based on the analysis of each of the one or more line segments and one or more arc segments.

2. The method of claim 1, wherein analyzing each of the one or more line segments comprises:

determining whether at least a portion of each of the one or more line segments satisfies 1) a threshold length between a line segment start point and a line segment stop point of each portion of each of the one or more line segments, and 2) a threshold angle with respect to the axis; and assigning an adjusted stitch density to each portion of each of the one or more line segments that satisfies the threshold length and the threshold angle.

3. The method of claim 1, wherein analyzing each of the one or more line segments comprises assigning a standard stitch density to each portion of each of the one or more line segments that does not satisfy one or more of a threshold length between a line segment start point and a line segment stop point, and a threshold angle with respect to the axis.

4. The method of claim 1, wherein the axis is a feed axis or a carriage axis.

5. The method of claim 1, wherein the analysis of each of the one or more arc segments comprises:

interpolating each of the one or more arc segments to provide a plurality of increments for each arc segment; and analyzing a first portion of a first arc segment of the one or more arc segments, wherein the first portion comprises a first increment and a second increment of the plurality of increments, wherein the first increment is adjacent the second increment, and further wherein the analysis of the first portion comprises:

analyzing the first increment having a first increment start point and a first increment stop point, wherein analyzing the first increment comprises determining that the first increment satisfies a threshold angle with respect to the axis;

analyzing the second increment having a second increment start point and a second increment stop point, wherein analyzing the second increment comprises determining that the second increment satisfies the threshold angle with respect to the axis; and upon determining that both the first increment and the second increment satisfy the threshold angle with respect to the axis, determining that the total length of the first increment and the second increment satisfy a threshold length and assigning an adjusted stitch density to the first portion.

6. The method of claim 5, wherein the analysis of each of the one or more arc segments further comprises:

analyzing a second portion of the first arc segment of the one or more arc segments, wherein the second portion comprises a third increment and a fourth increment of the plurality of increments, wherein the third increment is adjacent the fourth increment, and further wherein the analysis of the second portion comprises:

analyzing the third increment having a third increment start point and a third increment stop point, wherein analyzing the third increment comprises determining that the third increment satisfies a threshold angle with respect to the axis;

analyzing the fourth increment having a fourth increment start point and a fourth increment stop point, wherein analyzing the fourth increment comprises determining whether the fourth increment satisfies the threshold angle with respect to the axis; and upon determining that the fourth increment does not satisfy the threshold angle with respect to the axis, assigning a standard stitch density to the second portion.

7. The method of claim 1 further comprising:

identifying a stitch density of two or more adjacent elements; and assigning an intermediate stitch density to at least a portion of the sewing pattern.

8. A method for automatically adjusting stitch density between elements of a sewing pattern for sewing along an axis, the method comprising:

receiving a pattern having a plurality of pattern elements, wherein each of the plurality of pattern elements comprises one or more portions, and wherein the plurality of pattern elements comprises one or more arc segments, each of the one or more arc segments comprising one or more increments;

analyzing each of the one or more portions of the plurality of pattern elements to determine whether each of the plurality of pattern elements satisfies a threshold for assigning an altered stitch density to at least one portion of the plurality of pattern elements, wherein analyzing includes:

determining whether each increment of each of the one or more arc segments satisfies a threshold angle with respect to an axis; and determining whether each increment of each of the one or more arc segments that satisfies the threshold angle with respect to the axis further satisfies a threshold length; and assigning at least one of a standard stitch density, an altered stitch density, and an intermediate stitch density to each of the one or more portions of the plurality of pattern elements.

9. The method of claim 8, wherein the plurality of pattern elements comprises one or more line segments.

10. The method of claim 9, wherein analyzing each of the plurality of pattern elements comprises:

determining whether a portion of each of the one or more line segments satisfies a threshold length; and determining whether each portion of each of the one or more line segments that satisfies the threshold length satisfies a threshold angle with respect to the axis.

11. The method of claim 9, wherein each portion of the one or more line segments comprises a line segment start point and a line segment stop point, wherein the threshold length comprises a sewing distance between the line segment start point and the line segment stop point for each portion of the one or more line segments.

12. The method of claim 9, wherein assigning either a standard stitch density or an altered stitch density to each of the one or more portions of the plurality of pattern elements comprises assigning an altered stitch density to each portion of the one or more line segments that satisfies the threshold length and the threshold angle with respect to the axis.

13. The method of claim 8, wherein determining whether each increment of each of the one or more arc segments that satisfies the threshold angle with respect to the axis satisfies a threshold length comprises:

determining there is a plurality of adjacent increments that satisfy the threshold angle, each of the plurality of adjacent increments comprising an increment start point and an increment stop point; and determining whether the summed length of the plurality of adjacent increments that satisfy the threshold angle with respect to the axis satisfies a threshold length.

14. A method for automatically assigning variable stitch densities to pattern elements of a sewing pattern, the method comprising:

receiving a sewing pattern having a plurality of pattern elements, wherein the plurality of pattern elements comprises at least one of one or more line segments and one or more arc segments, and wherein each of the one or more arc segments comprises an arc segment start point and an arc segment stop point;

analyzing each of the plurality of pattern elements to determine whether at least a portion of each of the plurality of pattern elements satisfies a threshold length and a threshold angle with respect to an axis, wherein analyzing includes:

determining whether at least a portion of each of the one or more arc segments satisfies a threshold angle with respect to the axis; and determining whether the one or more arc segments satisfies a threshold length based on a sewing distance between the arc segment start point and the arc segment stop point; and automatically assigning a corresponding stitch density to each of the plurality of pattern elements based on the analysis.

15. The method of claim 14, wherein each of the one or more line segments comprises a line segment start point and a line segment stop point, wherein analyzing each of the plurality of pattern elements comprises:

determining whether each of the one or more line segments satisfies a threshold angle with respect to the axis; and determining whether at least a portion of each of the one or more line segments satisfies a threshold length based on a sewing distance between the line segment start point and the line segment stop point.

16. The method of claim 14, wherein determining whether at least a portion of each of the one or more arc segments satisfies a threshold angle with respect to the axis comprises:

determining a plurality of increments for each of the one or more arc segments, each of the plurality of increments comprising an increment start point and an increment stop point;

for a first increment of a first arc segment of the one or more arc segments, determining that the first increment satisfies the threshold angle with respect to the axis based on a first increment start point and a first increment stop point; and for a second increment of the first arc segment of the one or more arc segments, determining whether the second increment satisfies the threshold angle with respect to the axis based on a second increment start point and a second increment stop point.

17. The method of claim 16, wherein upon determining that the second increment satisfies the threshold angle, and determining the first increment and second increment satisfy a threshold length based on a sewing distance between the first increment start point and the second increment stop point, assigning an altered stitch density to the first increment and the second increment, and wherein upon determining that the second increment does not satisfy the threshold angle, assigning a standard stitch density to the first increment and the second increment.

* * * * *